US012480267B2

(12) United States Patent
Keller

(10) Patent No.: US 12,480,267 B2
(45) Date of Patent: Nov. 25, 2025

(54) INDICATOR SLEEVE FOR A TRAFFIC DIRECTOR

(71) Applicant: SeeMeeS, LLC, South Jordan, UT (US)

(72) Inventor: Jack Keller, South Jordan, UT (US)

(73) Assignee: SEEMEES, LLC, South Jordan, UT (US)

( * ) Notice: Subject to any disclaimer, the term of this patent is extended or adjusted under 35 U.S.C. 154(b) by 0 days.

(21) Appl. No.: 18/661,455

(22) Filed: May 10, 2024

(65) Prior Publication Data

US 2024/0295090 A1 Sep. 5, 2024

Related U.S. Application Data

(60) Continuation of application No. 18/310,074, filed on May 1, 2023, now Pat. No. 12,000,099, which is a division of application No. 17/066,380, filed on Oct. 8, 2020, now Pat. No. 11,674,274.

(60) Provisional application No. 63/020,974, filed on May 6, 2020, provisional application No. 62/913,989, filed on Oct. 11, 2019.

(51) Int. Cl.

| | |
|---|---|
| ***E01F 9/623*** | (2016.01) |
| ***E01F 9/615*** | (2016.01) |
| ***E01F 9/627*** | (2016.01) |
| ***E01F 9/654*** | (2016.01) |
| *E01F 9/688* | (2016.01) |

(52) U.S. Cl.

CPC ..... *E01F 9/629* (2016.02); *E01F 9/617* (2016.02); *E01F 9/654* (2016.02); *E01F 9/688* (2016.02)

(58) Field of Classification Search

CPC . E01F 9/617; E01F 9/623; E01F 9/627; E01F 9/629; E01F 9/654; E01F 9/688

See application file for complete search history.

(56) References Cited

U.S. PATENT DOCUMENTS

| | | | | | |
|---|---|---|---|---|---|
| 1,879,761 | A * | 9/1932 | Neiler | G09F 21/045 | 40/587 |
| 2,935,238 | A * | 5/1960 | Koehler | B65D 5/008 | 229/162.1 |
| 4,660,310 | A * | 4/1987 | Farmer | G09F 15/0006 | 40/607.06 |
| 4,960,302 | A * | 10/1990 | Walters | B62B 3/1436 | 296/78.1 |
| 5,487,618 | A * | 1/1996 | Cox | E01F 15/0469 | 52/301 |
| 5,605,414 | A * | 2/1997 | Fuller | E01F 15/0469 | 40/611.04 |
| 6,263,601 | B1 * | 7/2001 | Emert | G09F 13/04 | 70/164 |

(Continued)

OTHER PUBLICATIONS

Non-Final Office Action received for U.S. Appl. No. 17/066,380, mailed on Oct. 19, 2021, 8 pages.

*Primary Examiner* — Gary S Hartmann

(74) *Attorney, Agent, or Firm* — Workman Nydegger

(57) ABSTRACT

An indicator sleeve for used with a traffic director. The indicator sleeve includes a receptacle configured to removably receive therein a side panel of the traffic director, an outwardly facing panel having or being configured to have an advertisement or directional indicator printed or otherwise disposed thereon, and an attachment mechanism configured to selectively secure the indicator sleeve to the traffic director.

12 Claims, 24 Drawing Sheets

(56) References Cited

U.S. PATENT DOCUMENTS

| | | | | |
|---|---|---|---|---|
| 6,448,902 | B1 * | 9/2002 | Tung | B60Q 7/00 340/471 |
| 6,692,182 | B1 * | 2/2004 | Fenimore | G09F 15/0025 404/7 |
| 6,971,198 | B2 * | 12/2005 | Venegas, Jr. | E01F 15/003 40/607.01 |
| 7,228,813 | B2 * | 6/2007 | Flamingo | E01F 9/654 116/63 P |
| 8,015,737 | B2 * | 9/2011 | Venegas, Jr. | E01F 15/003 40/606.12 |
| 9,117,380 | B2 * | 8/2015 | Walters | G09F 15/0075 |
| 9,725,856 | B2 * | 8/2017 | Povoli | E01F 9/578 |
| 11,674,274 | B2 * | 6/2023 | Keller | E01F 9/654 404/9 |
| 12,000,099 | B2 * | 6/2024 | Keller | E01F 9/617 |
| 2004/0074122 | A1 * | 4/2004 | Goodwin | G09F 21/042 40/592 |
| 2005/0166431 | A1 * | 8/2005 | Boron | G09F 15/0056 40/607.03 |
| 2008/0219762 | A1 * | 9/2008 | Maybee | E01F 15/141 404/6 |
| 2010/0247237 | A1 * | 9/2010 | Motta | E01F 13/02 404/6 |
| 2012/0090207 | A1 * | 4/2012 | Johnston | G09F 15/0075 40/606.01 |

* cited by examiner

INDICATOR SLEEVE FOR A TRAFFIC DIRECTOR

CROSS-REFERENCE TO RELATED APPLICATIONS

This application is a continuation of U.S. patent application Ser. No. 18/310,074, filed May 1, 2023, entitled TRAFFIC DIRECTOR SYSTEM AND METHODS FOR USE THEREOF, which is a divisional application of U.S. patent application Ser. No. 17/066,380, filed Oct. 8, 2020, now U.S. Pat. No. 11,674,274, issued on Jun. 13, 2023, entitled TRAFFIC DIRECTOR AND SYSTEM AND METHOD FOR USE THEREOF, which claims the benefit of and priority to U.S. Provisional Patent Application No. 63/020,974, filed May 6, 2020, entitled TRAFFIC DIRECTOR AND SYSTEM AND METHOD FOR USE THEREOF, and U.S. Provisional Patent Application No. 62/913,989, filed Oct. 11, 2019, entitled TRAFFIC DIRECTOR AND SYSTEM AND METHOD FOR USE THEREOF. The entirety of each of the forgoing applications is incorporated herein by reference.

BACKGROUND

1. The Field of the Invention

The present disclosure relates generally to systems, methods, and apparatus for directing traffic. More specifically, the present disclosure relates to traffic director systems, methods, and apparatus.

2. Background and Relevant Art

Traffic cones and traffic director systems are often used on roads to direct traffic and provide warnings to oncoming vehicles. Traffic cones and systems are often used, for example, to guide traffic around an accident or other hazard on the road, such as construction zones and lane closures. However, current traffic cones lack durability such that vehicles striking cones result in cone failure. In addition, current traffic cones, when formed together in a system to guide traffic, lack sufficient visual indicators to clearly convey directional instructions to drivers. Also, it may be difficult for construction workers or emergency personnel to form traffic cone systems that clearly indicate instructions to drivers to avoid hazards in all cases using the same cones. Current traffic cones are also susceptible to instability when encountering air movement created by natural winds and the passing of vehicles. Additionally, storage and transportation of a large number of current traffic cones may be difficult due to spatial limitations.

Accordingly, there are a number of problems with traffic directors and traffic director systems that need to be addressed.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Embodiments described in the present disclosure solve one or more problems in the art with systems, methods, and apparatus for directing traffic. More specifically, the present disclosure relates to traffic director systems, methods, and apparatus. In one embodiment of the present disclosure, for example, a traffic director includes a distal end and a proximal end, two or more sides extending upward from the proximal end at an angle toward the distal end, a proximal notch disposed near the proximal end between two adjacent sides, and the proximal notch forms a first flexion point of the traffic director. The traffic director can further include one or more recessed channels formed in at least one of the two or more sides. The one or more recessed channels forms a second flexion point of the traffic director.

In one embodiment of the present disclosure, a traffic director includes two or more sides, each side having one or more flexion points and a directional indicator disposed on at least one of the two or more sides. In such an embodiment, at least one of the one or more flexion points may comprise a recessed channel extending across at least one of the two or more sides. In addition, at least one of the one or more flexion points includes a notch disposed at or near a proximal end of the traffic director, the notch comprising a portion of removed material between two adjacent sides of the two or more sides.

In one embodiment, a system of traffic directors includes a plurality of traffic directors, each traffic director comprising a distal end and a proximal end, two or more sides extending upward from the proximal end at an angle toward the distal end, a proximal notch disposed near the proximal end between two adjacent sides, and a first directional indicator disposed on at least one of the two or more sides. In such an embodiment, each of the plurality of cones is arranged in position relative to one or more other traffic directors of the plurality of traffic directors such that the directional indicator conveys instructions to a driver of a vehicle approaching the system of traffic directors during use.

In at least one embodiment, a first traffic director includes at two or more sides having an area for directional indicators and at least two openings that correspond with the at least two sides of a second traffic director, such that the first traffic director may be stacked upon the second traffic director by rotating the second traffic director by ninety degrees.

In some embodiments, a removable indicator sleeve is removably secured to a traffic indicator, the removable indicator sleeve having either an advertisement, a directional indicator, or any graphic or text printed thereon.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. These and other features and advantages of such implementations may be realized and obtained by means of the instruments and combinations particularly pointed out in the appended claims. These and other features of the present invention will become more fully apparent from the following description and appended claims or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and should not therefore be considered to be limiting of its scope, the invention will be described and explained with additional specificity and detail through the use of the accompanying drawings in which.

DETAILED DESCRIPTION

Embodiments described in the present disclosure solve one or more problems in the art with systems, methods, and apparatus for directing traffic. More specifically, the present disclosure relates to traffic director systems, methods, and apparatus that are durable and stable, and that can be organized to form adaptable, customizable traffic director systems capable of directing traffic in any number of ways.

Figure 1:
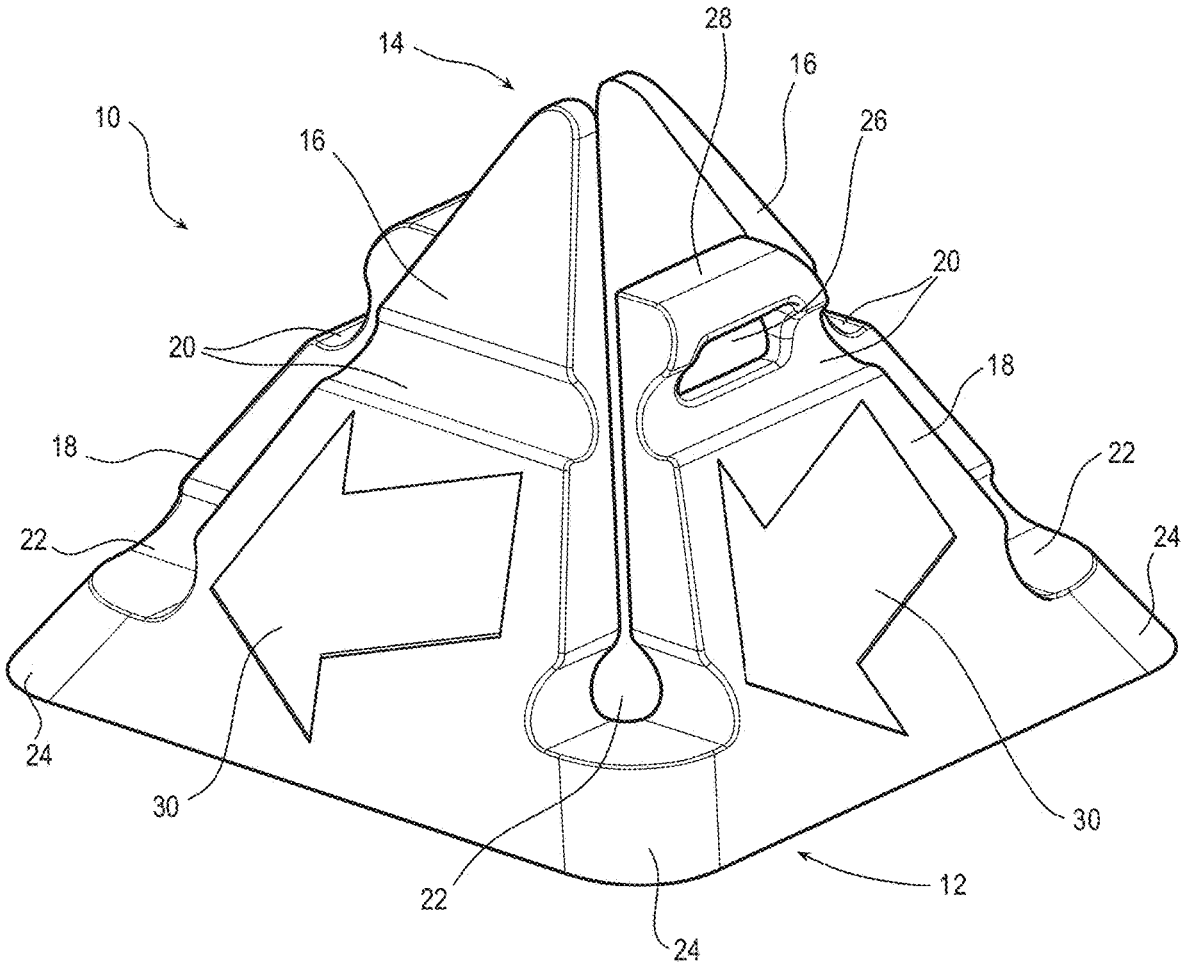
FIG. 1 illustrates a perspective view of an embodiment of a traffic director, including directional indicators, according to the present disclosure.

Turning now to the figures, FIG. 1 illustrates a perspective view of an embodiment of a traffic director 10. In the illustrated embodiment, traffic director 10 includes four sides and is generally shaped as a pyramid having a square base. In at least one embodiment, traffic director 10 includes more or less than four sides, including two, three, five, six, or more than six sides. For ease of reference herein, proximal end 12 of traffic director 10 forms a base configured to rest on a support surface, such as the ground, and distal end 14 of traffic director 10 is opposed to proximal end 12.

The four sides of the illustrated embodiment in FIG. 1 include two major sides 16 and two minor sides 18. In at least one embodiment, major sides 16 taper upward at an angle from proximal end 12 towards distal end 14 and converge toward a point (not illustrated) at or near distal end 14. Alternatively, some embodiments include sides 16, 18 that do not extend at an angle and thus do not converge toward a point at or near the distal end 15. In at least one embodiment, major sides 16 include one or more recessed channels 20 extending thereacross. The position, width, and shape of recessed channels 20 may vary in one or more other embodiments. In addition, in at least one embodiment, major sides 16 may each include more than one recessed channel 20 extending thereacross.

Additionally, some embodiments comprise sides 16, 18 that are integral with traffic director 10, while other embodiments comprise sides 16, 18 that are separable from the other components of traffic director 10. For example, in at least one embodiment, each of the sides 16, 18 is selectively removable from a base portion of traffic director 10. In another embodiment, one or more sides 16, 18 are collapsible, such that traffic indicator 10 may be stored more easily. Also, some embodiments of traffic indicator 10 comprise a single piece, while other embodiments are manufactured in parts and assembled to either permanently or reversibly form a traffic indicator 10.

In the illustrated embodiment, a single recessed channel 20 having a semi-circular cross-sectional shape extends horizontally across each major side 16. Recessed channels 20 each form a flexion point of the major sides such that major sides 16 can flex and bend at recessed channels 20 to avoid failure when acted upon by outside forces, such as from vehicles running over or hitting traffic director 10 during use.

Minor sides 18 may also include recessed channels 20 that serve the same purpose as recessed channels 20 extending across major sides 16 as discussed above. In addition, like recessed channels 20 extending across major sides 18, recessed channels 20 extending across minor sides 18 may vary in position, number, shape, and size in one or more other embodiments.

As illustrated, minor sides 18 of traffic director 10 extend upward from proximal end 12 at an angle and taper upward toward distal end 14. In at least one embodiment, minor sides 18 do not extend upward as far as major sides 16. For example, as shown in FIG. 1, minor sides 18 extend upward but do not come to a point like major sides 16. Rather than forming triangles like those of major sides 16, minor sides 18 may form trapezoids.

In addition, traffic director 10 may include a proximal corner notch 22 at each proximal corner 24 where each of the major sides 16 meets with a minor side 18 near proximal end 12 of traffic director 10. The illustrated embodiment of traffic director 10 in FIG. 1 includes four proximal corner notches 22 due to the square pyramid shape thereof. One will appreciate that other embodiments of traffic directors having more or less than four sides may inherently include more or less proximal corners and corresponding proximal corner notches.

In any case, proximal corner notches 22, such as those shown in FIG. 1, may comprise recessed portions of removed material where each side, minor 18 and major 16, come together near proximal end 12. Proximal corner notches 22 provide flexion points for each side 16, 18 to flex near proximal end 12 when acted upon by an outside force, such as by passing cars coming into contact with traffic director 10. The shape and size of proximal corner notches 22 are such that they are large enough to provide sufficient flexible characteristics to traffic director 10, as described, but small enough to maintain the structural integrity of traffic director 10 such that sides 16, 18 do not tear off or otherwise fail in response to outside forces acting thereon.

In at least one embodiment, traffic director 10 includes one or more apertures 26 formed through one or more of sides 16 and/or 18. In the illustrated embodiment of FIG. 1, aperture 26 is formed through minor side 18 near a distal end thereof, thus forming a handle 28 for grasping. Handle 28 may be formed at various other locations on traffic director 10, including sides 16 and/or 18 other than those shown by way of example handle 28 in FIG. 1. Formation of handle 28 provides one or more grasping locations for a user to easily grab and lift traffic director 10. Aperture 26 not only forms handle 28, aperture 26 also reduces the weight of traffic director 10 and saves on material costs during manufacturing. In addition, aperture 26 can be strategically placed to increase the flexibility of various sides 16, 18 and traffic director 10 overall to improve durability during use, as noted above with reference to recessed channels 20.

In addition to providing flexion points and reducing the overall weight of the traffic director, recessed channels 20, proximal corner notches 22, apertures 26, and any other slots or gaps defined by the separation between independent sides 16, 18 can provide increased stability to the traffic director 10 by allowing air to freely pass both around and through the structure of the traffic director 10. In embodiments that include these features, the impact of air movement created by natural winds and/or the passing of vehicles is minimized due to the ability of the air to pass through the traffic director without causing it to move, tip over or experience significant placement disruption. Thus, the traffic director is more stable in higher traffic areas or other environmental conditions that would cause placement disruption of the traffic director.

Figure 2:
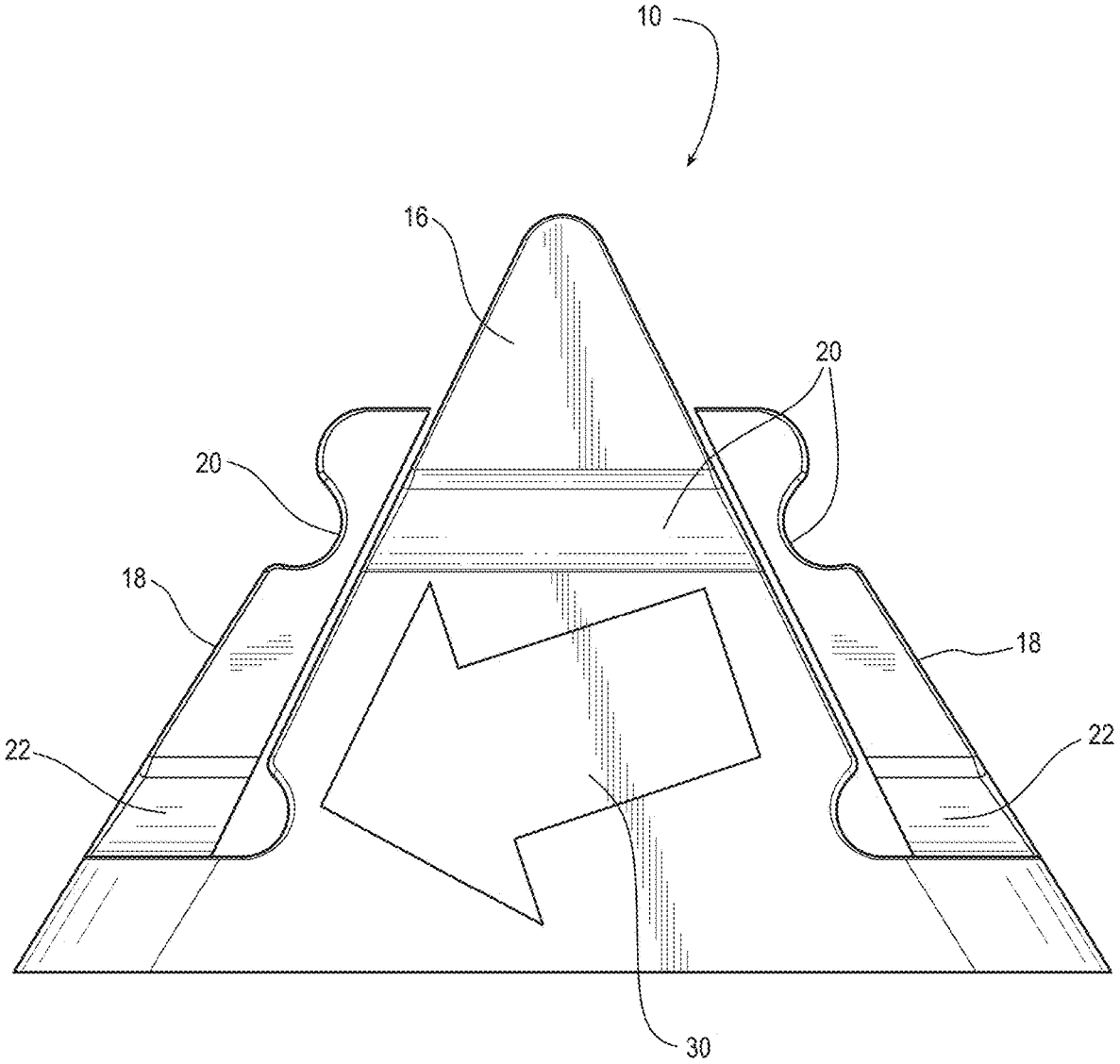
FIG. 2 illustrates a front view thereof.
Figure 3:
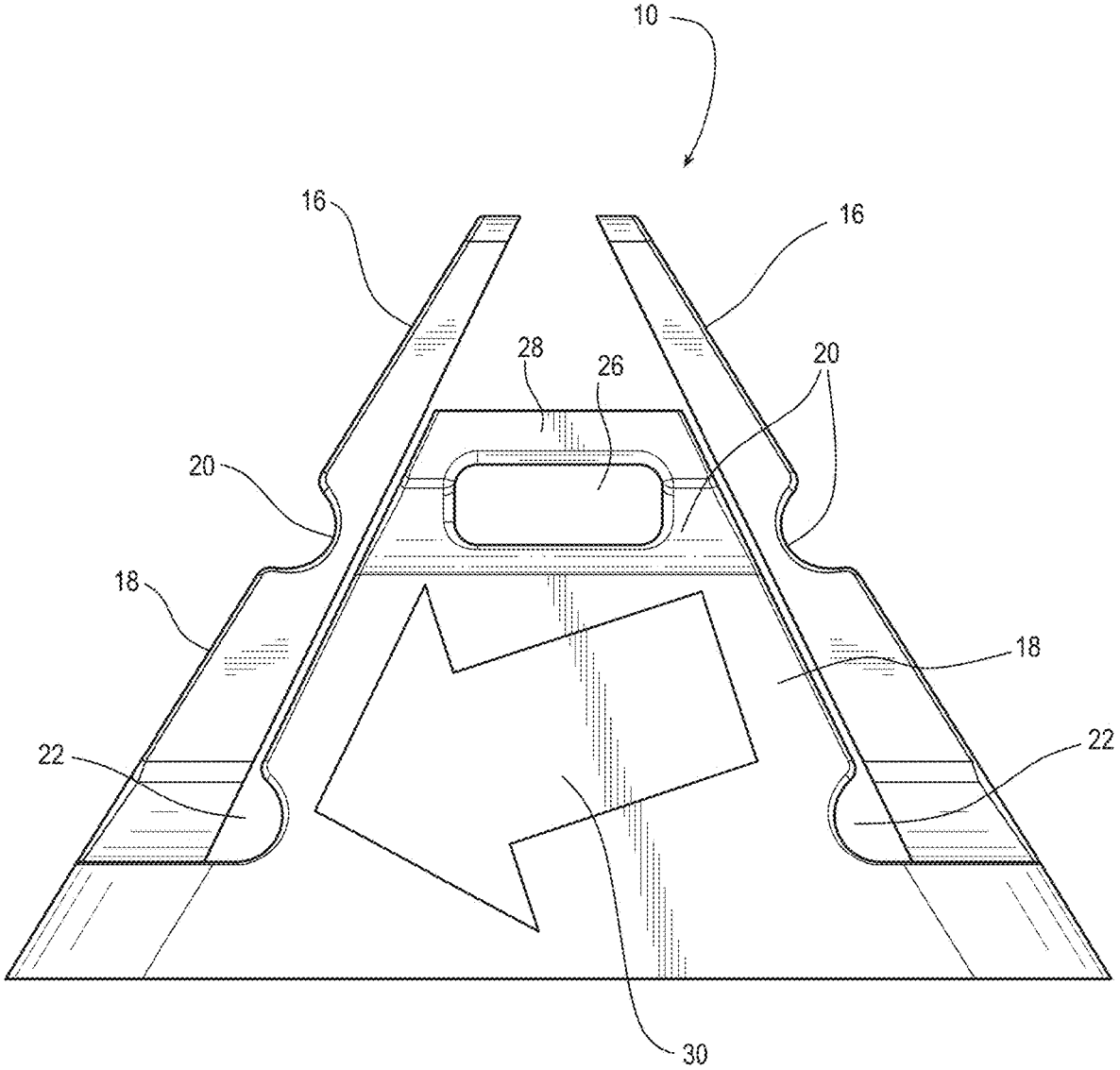
FIG. 3 illustrates a left side view thereof.
Figure 4:
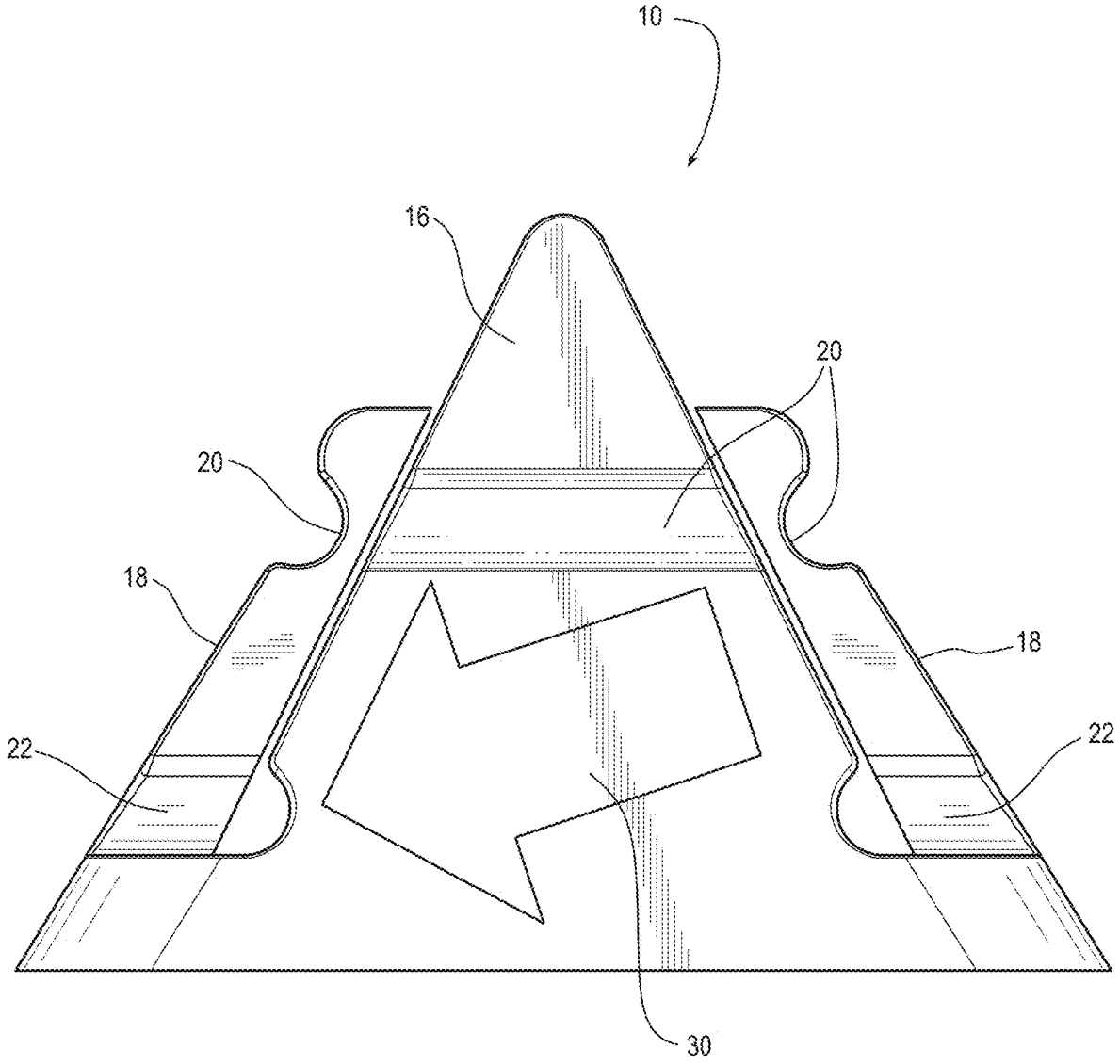
FIG. 4 illustrates a back view thereof.
Figure 5:
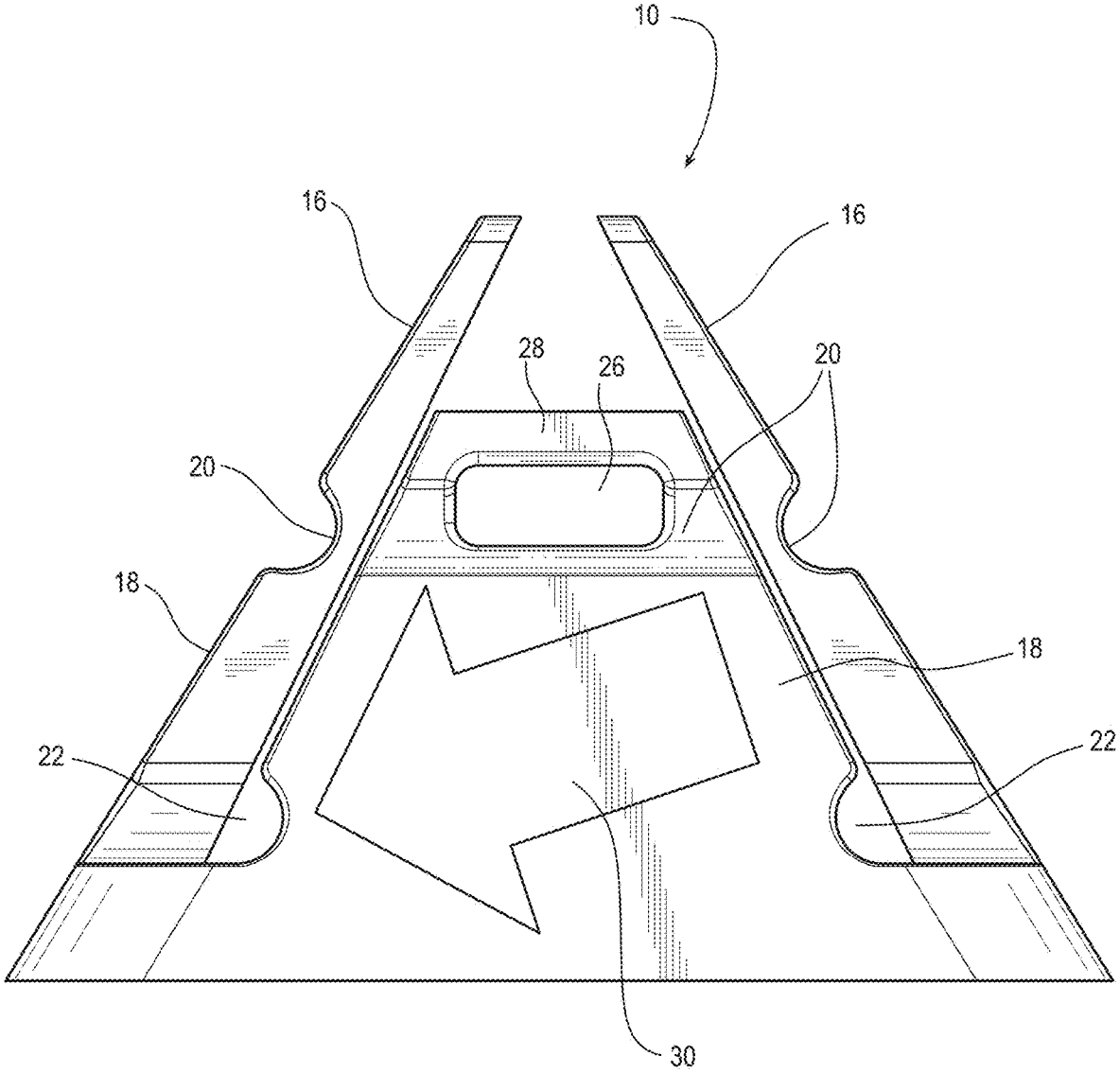
FIG. 5 illustrates a right side view thereof.
Figure 6:
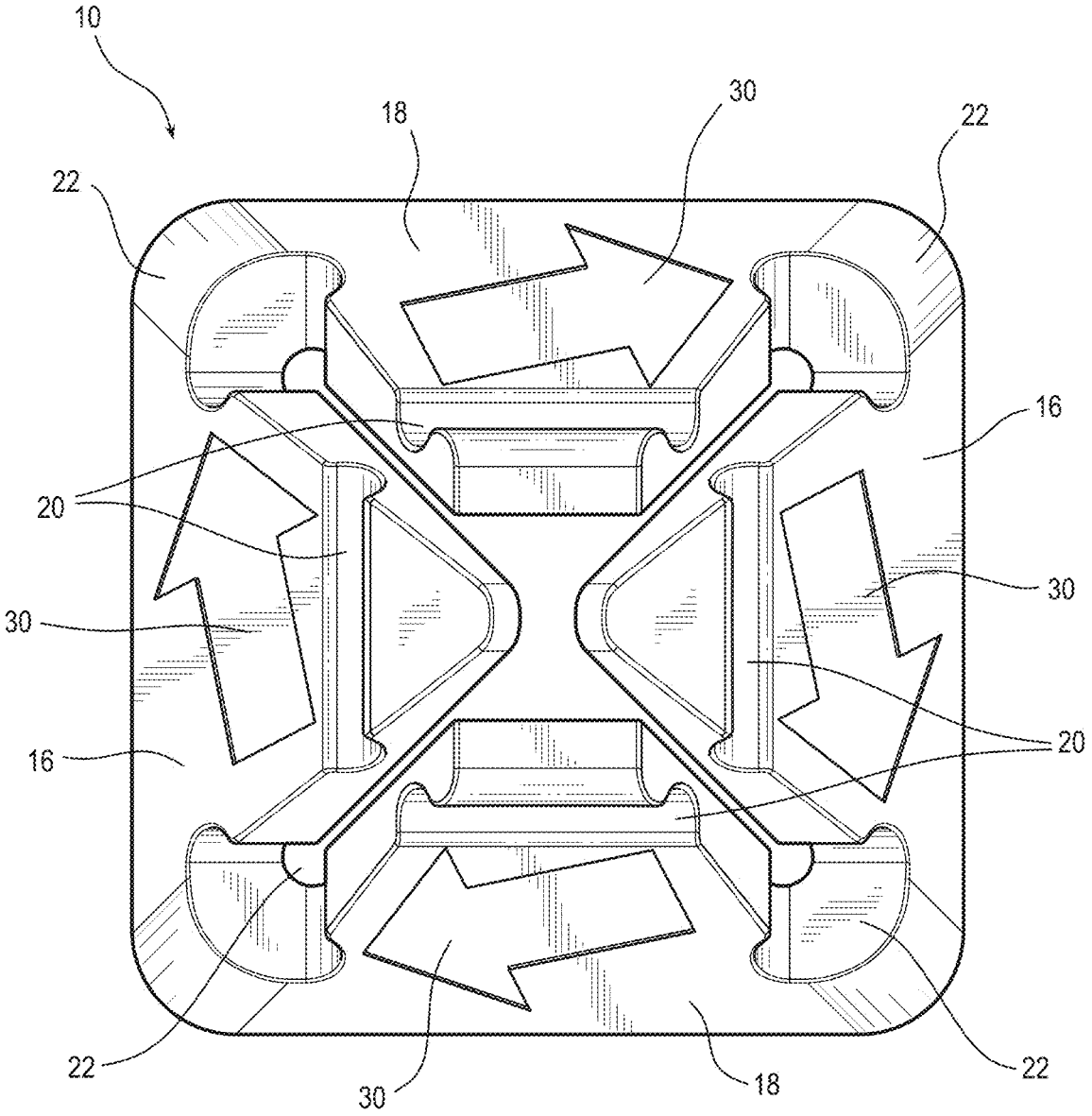
FIG. 6 illustrates a top view thereof.
Figure 7:
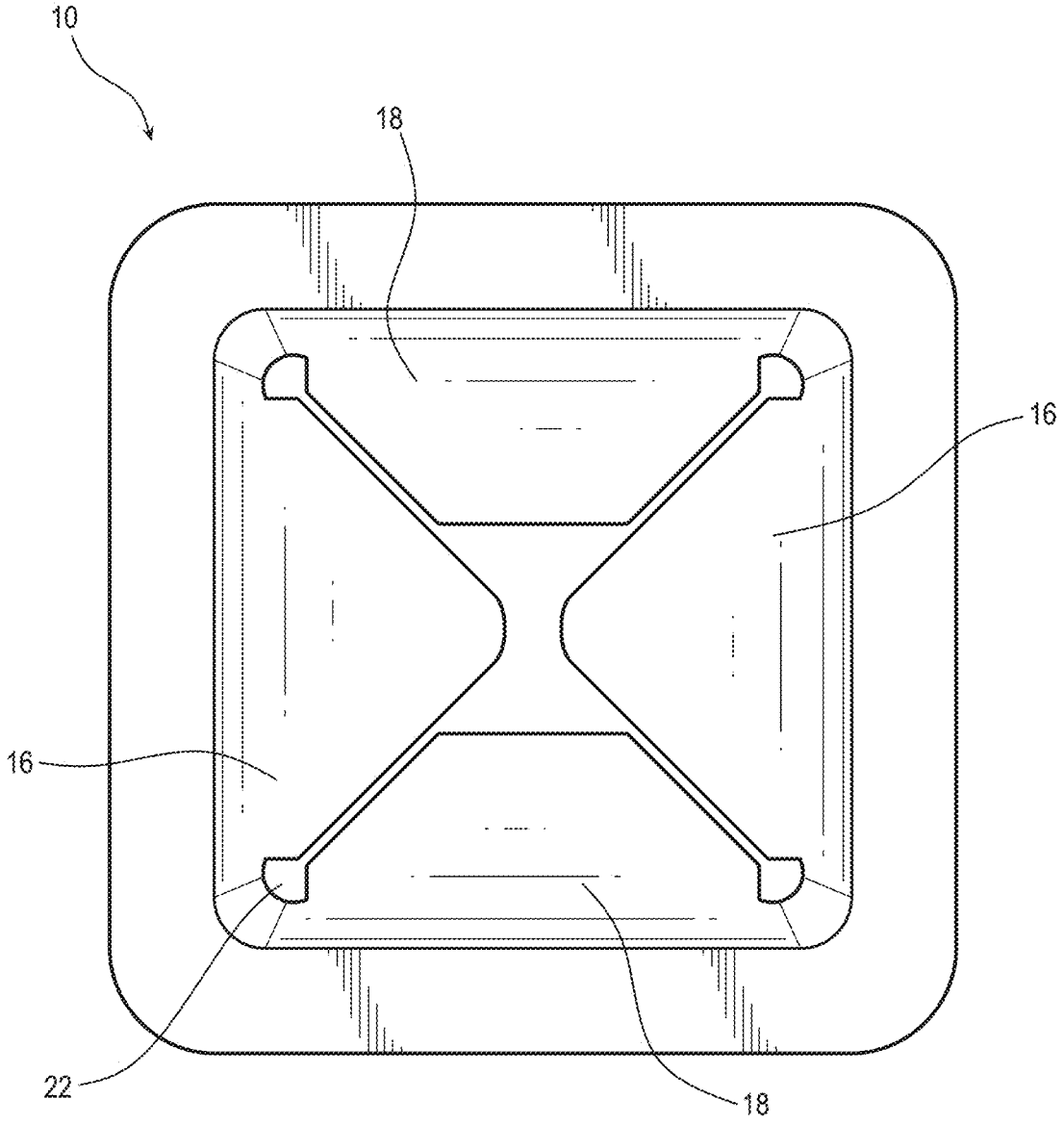
FIG. 7 illustrates a bottom view thereof.

FIGS. 2-7 illustrate various other views of traffic director 10, including a front view illustrated in FIG. 2, a left side view illustrated in FIG. 3, a back view illustrated in FIG. 4, a right side view illustrated in FIG. 5, a top view illustrated in FIG. 6, and a bottom view illustrated in FIG. 7. In each of FIGS. 2-7, the various features of traffic director 10 described herein are shown at various different angles to further clarify an embodiment of traffic director 10. For example, each of FIGS. 2-7 illustrate traffic director 10 having major sides 16, minor sides 18, recessed channels 20, proximal notches 22, apertures 26, and handles 28.

In addition to the above-noted embodiments and features of traffic director 10, in at least one embodiment, traffic director 10 includes one or more directional indicators 30. Each side 16, 18 may include one or more directional indicators 30. In the illustrated embodiment, each side 16, 18 includes a single directional indicator 30 in the form of an arrow. In at least one embodiment, directional indicators 30 are printed onto traffic director 10. In at least one embodiment, directional indicators are recessed into, molded, or otherwise indicated on traffic director 10. In some embodiments, material is removed from each side 16, 18 to form the directional indicators 30 as well as to define a hole or recess through which air may pass through the body of the traffic director 10 without moving or tipping the traffic director 10. In embodiments comprising separable sides 16, 18, a variety of directional indicators 30 can be provided to enable a user to selectively install different directional indicators 30 for different needs.

As used herein, the term "directional indicator" may include any directional or other instructional symbol that conveys a direction or instruction to the driver of a vehicle. Such directional indicators, which may or may not be commonly used on traffic signs, including construction signs, may include, but are not limited to, arrows, stop signs, warning indicators such as "X" symbols, merging symbols, "DO NOT ENTER" symbols, or any other symbol that may be useful to direct or instruct drivers of vehicles where a traffic director 10 is placed. Traffic director 10 may include one or more of a combination of similar or different directional indicators as needed. In addition, directional indicators 30 may be printed on, molded with, secured to, or formed by removing material from traffic director 10. In at least one embodiment, directional indicators 30 may be reflective.

Also, with reference to all embodiments described herein and shown in the figures, traffic directors may comprise materials that are suitable for traffic directors, including durable, flexible, and/or weather resistant materials. Such materials may include, but are not limited to, rubbers, plastics, polymers, composites thereof and so forth, as generally known in the art. Also, traffic directors of the present disclosure may be manufactured by various processes, such as but not limited to molding or printing a single, complete piece or producing various components as described herein for subsequent assembly of a completed piece.

Figure 8:
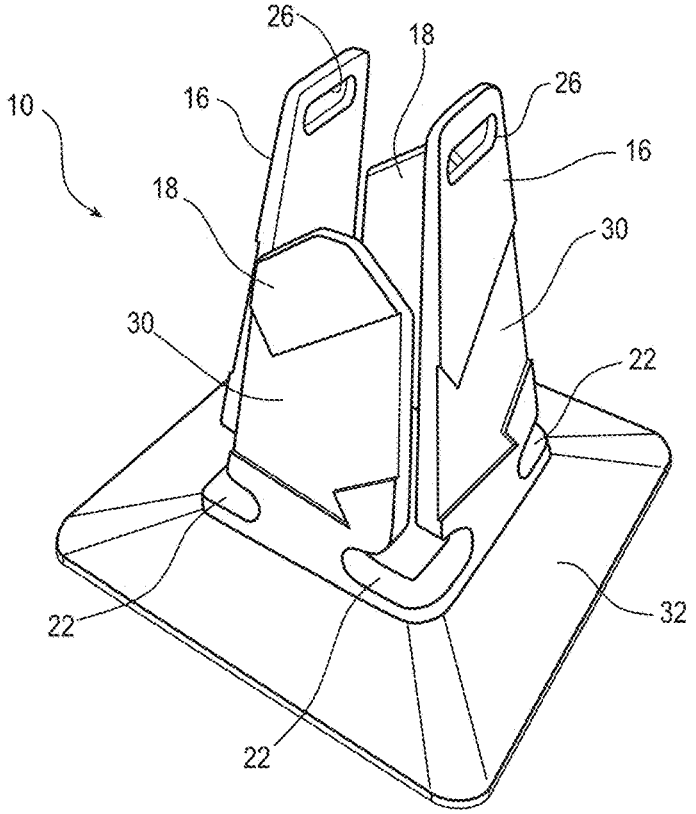
FIG. 8 illustrates a perspective view of an embodiment of a traffic director, including directional indicators, according to the present disclosure.

FIG. 8 illustrates a perspective view of another embodiment of a traffic director 10, including major and minor sides 16, 18 extending upward from an outwardly extending base 32. Apertures 26 are located near distal end of major sides 16 and proximal notches 22 are disposed between adjacent sides 16, 18 near base 32. In addition, directional indicators 30 include arrows recessed into sides 16, 18. In such an embodiment, directional indicators 30 are molded or otherwise integrally formed with traffic director 10.

Figure 9:
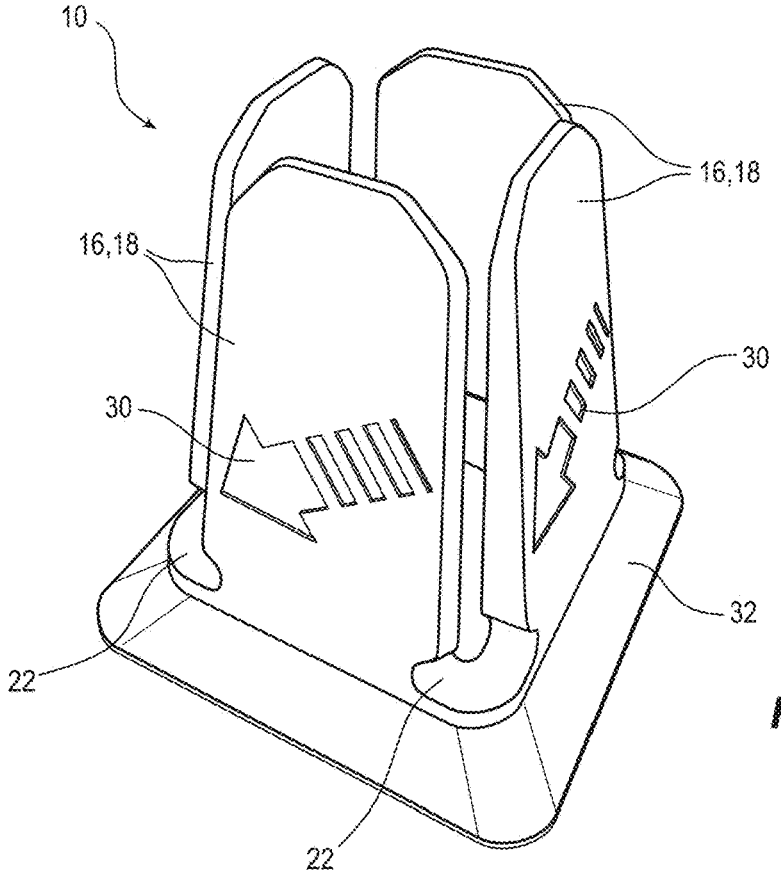
FIG. 9 illustrates a perspective view of an embodiment of a traffic director, including directional indicators, according to the present disclosure.

FIG. 9 illustrates a perspective view of another embodiment of a traffic director 10, including directional indicators 30 recessed into sides 16, 18 and an outwardly extending base 32. One will note that the traffic director 10 illustrated in FIG. 9 does not include apertures forming handles and sides 16, 18 are the same height and shape. In addition, the various embodiments of traffic directors 10 illustrated herein may be any color suitable for traffic control and warning purposes.

In addition, embodiments of traffic directors 10 illustrated in FIGS. 1-9 include directional indicators 30 that show the same arrow in the same orientation regardless of which side 16, 18 is facing oncoming traffic. That is, directional indicators 30 shown in FIGS. 1-9 include left pointing arrows. This is best illustrated in the top view shown in FIG. 6. In at least one embodiment, traffic director 10 includes different directional indicators 30 on different sides 16, 18, either arrows pointing in different directions, or indicators other than arrows, or a combination thereof.

Figure 10:
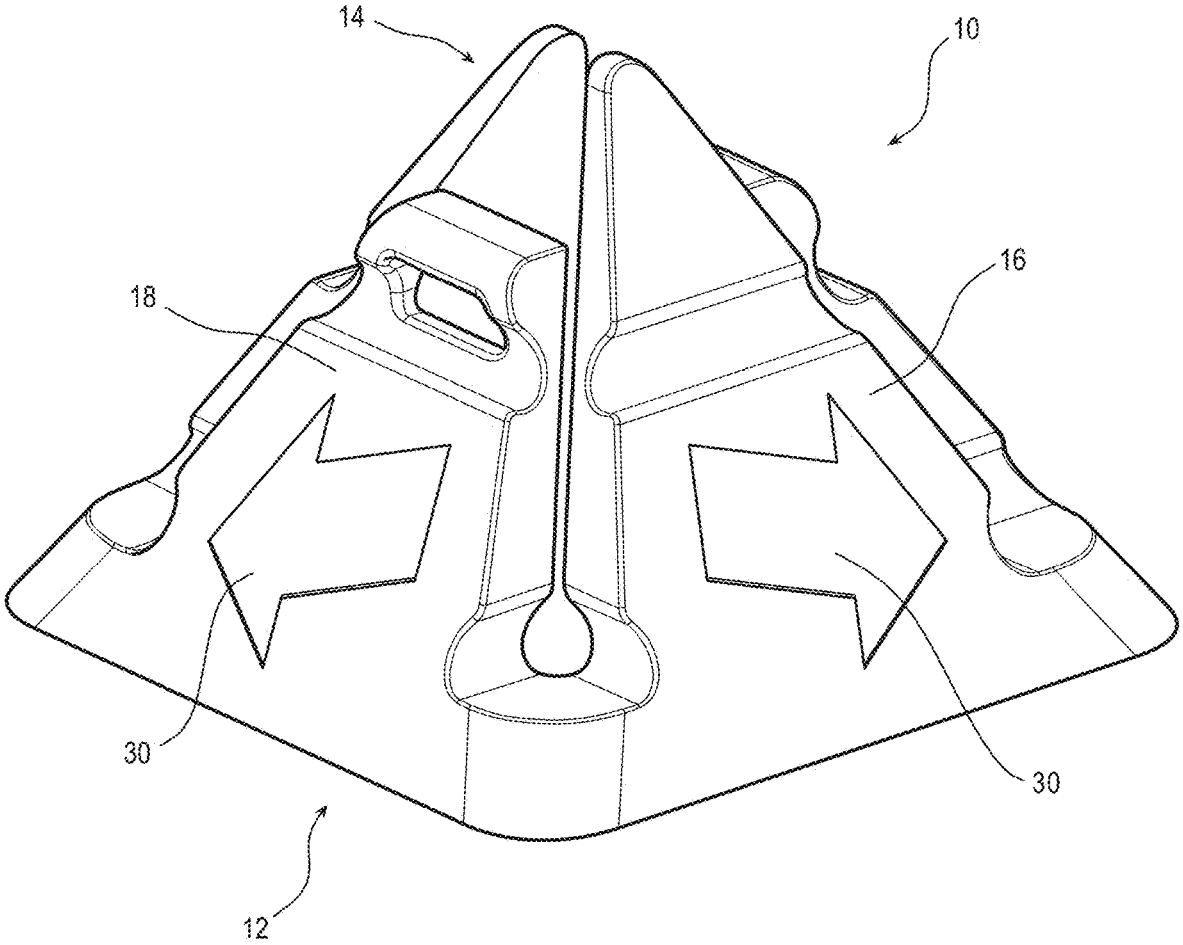
FIG. 10 illustrates a perspective view of an embodiment of a traffic director, including directional indicators, according to the present disclosure.

For example, FIG. 10 illustrates a perspective view of an embodiment of a traffic director 10, including directional indicators 30 that include arrows pointing in different directions. The arrow shown on minor side 18 points left and the arrow on major side 16 points right. Advantageously, in such an embodiment, traffic director 10 can be used to direct traffic in different directions, depending on which side 16, 18 is facing oncoming traffic. In this way, a road worker or other user can strategically place traffic director 10 in various orientations to display unique directional indicators 30 or other instructional symbols on traffic director 10 to different vehicles passing traffic director 10 from different directions.

Figure 11:
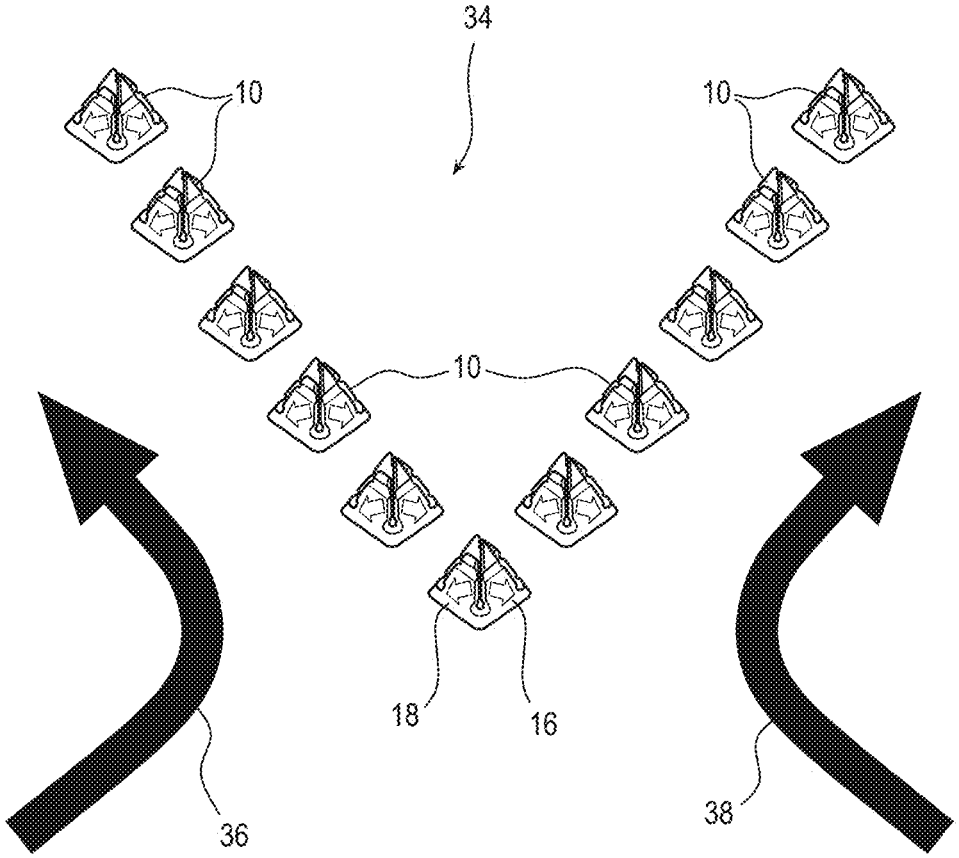
FIG. 11 illustrates an embodiment of a system of traffic directors including a plurality of traffic directors having directional indicators thereon, arranged together for directing traffic, according to the present disclosure.

Along these lines, an embodiment of a system 34 of traffic directors comprising a plurality of traffic directors 10 is shown in FIG. 11. Each of the plurality of traffic directors 10 includes directional indicators 30 similar to those shown in FIG. 10, with arrows on minor sides 18 facing left and arrows on major sides 16 facing right. When arranged as shown in FIG. 11, vehicles approaching straight towards the traffic directors 10 from the left 36 are directed left based on the left-pointing arrow on the minor side 18 of each traffic director 10. Conversely, vehicles approaching straight towards the traffic directors 10 from the right 38 are directed right based on the right-pointing arrow on the major side 16 of each traffic director 10.

Figure 12:
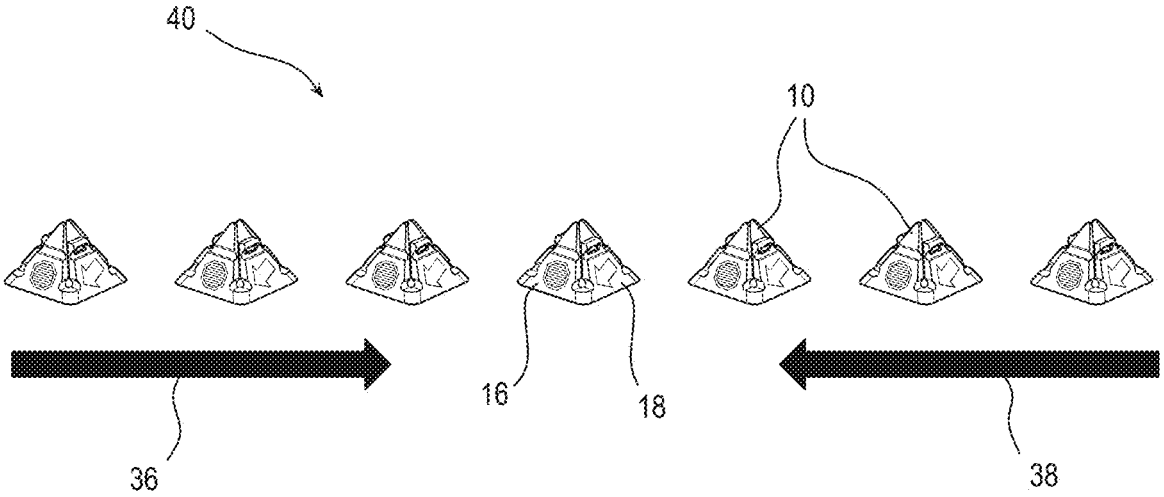
FIG. 12 illustrates an embodiment of a system of traffic directors including a plurality of traffic directors having directional indicators thereon, arranged together for directing traffic, according to the present disclosure.

FIG. 11 is an exemplary system 34 of a plurality of traffic directors 10 that can be arranged to direct vehicle traffic in a certain way. One or more other embodiments may include the same or different cones arranged in the same or different configuration relative to one another to direct traffic in any number of ways. For example, as shown in FIG. 12, system 40 includes a plurality of traffic directors 10 disposed in a line. Traffic directors 10 of FIG. 12 include a left-pointing arrow on minor side 18 of each traffic director 10 and a stop sign on major side 16 of each traffic director 10.

As shown, if arranged in a line, the plurality of cones 10 signal different instructions to vehicles approaching from different directions. For example, as shown, vehicles approaching from the right 38 see minor side 18 of each traffic director 10 and are thus instructed to continue. Conversely, vehicles approaching from the left 36 see major side 16 of each traffic director 10 and are thus instructed to stop.

Again, as noted above, any number of different configurations of traffic directors 10 having various directional indicators 30 thereon can be employed in one or more other embodiments. Advantageously, users can arrange such traffic directors 10 in unique, customized configurations and positions relative to one another to direct or otherwise instruct drivers approaching traffic directors 10.

In some embodiments, multiple different directional indicators 30 are interchangeable. For example, sides 16, 18 may be separable and interchangeable with sides 16, 18 having different directional indicators 30. Alternatively, various directional indicators 30 may be provided and may be selectively attachable to sides 16, 18 by means of hook and loop fastener, magnets, nonpermanent adhesives, or the like. Further, directional indicators 30 may be integral with traffic director 10 but selectively rotatable, such that a right-pointing arrow may be rotated or otherwise repositioned to produce an arrow in any alternative direction.

FIGS. 13-31 illustrate exemplary embodiments of the present disclosure wherein stacking of traffic directors for storage and transportations has been spatially optimized by virtue of a design comprising two sides or paddles 18. The illustrated embodiment also reduces the amount of material used by reducing the number of sides 18 without compromising the structural integrity of the traffic directors.

Figure 13:
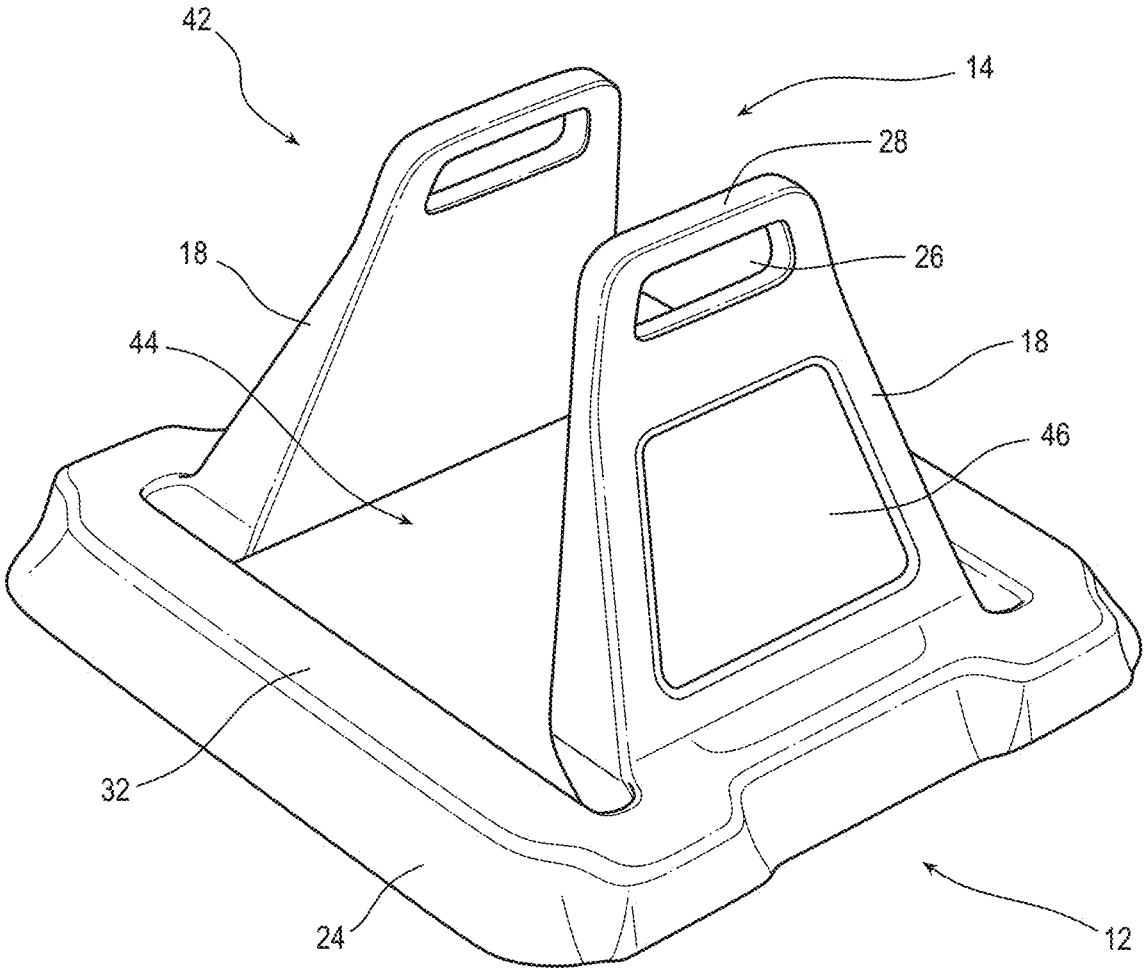
FIG. 13 illustrates a perspective view of another exemplary embodiment of a traffic director according to the present disclosure.

For example, FIG. 13 illustrates a perspective view of an embodiment of a traffic director 42. In the illustrated embodiment, traffic director 42 includes two sides or paddles 18 and is generally shaped as a pyramid having a square base 32 at its proximal end 12 configured to rest on a support surface, as well as a distal end 14 that is opposed to proximal end 12. As illustrated, sides 18 of traffic director 42 extend upward from proximal end 12 at an angle and taper upward toward distal end 14. As illustrated, sides 18 are integral with base 32 and traffic director 42 forms a single piece. Alternatively, some embodiments include sides 18 that are separable from base 32, in some embodiments being interchangeable and in other embodiments being permanently attached during assembly.

Figure 20:
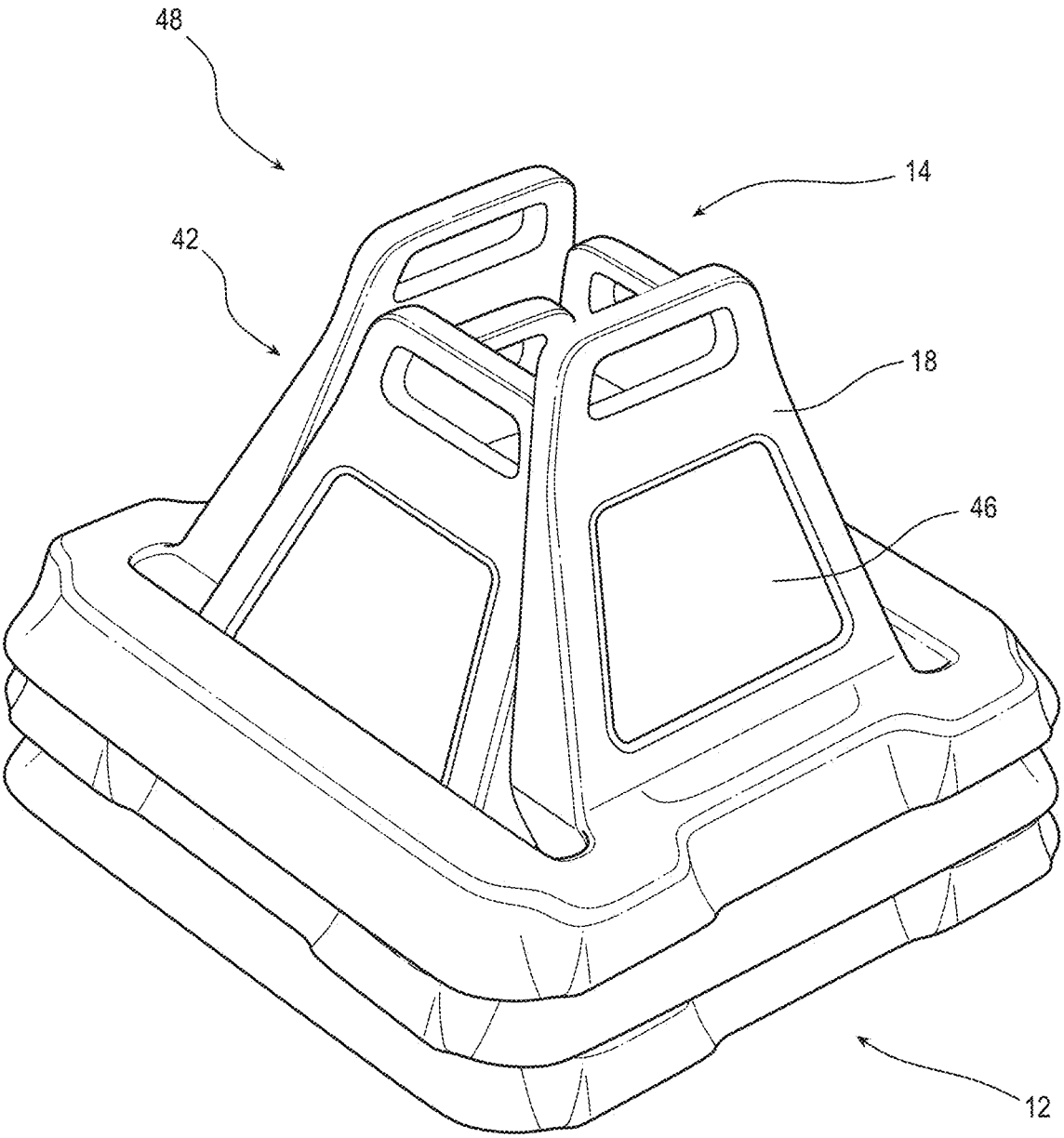
FIG. 20 illustrates a perspective view of an embodiment of a system of traffic directors in a stacked configuration, according to the present disclosure.
Figure 21:
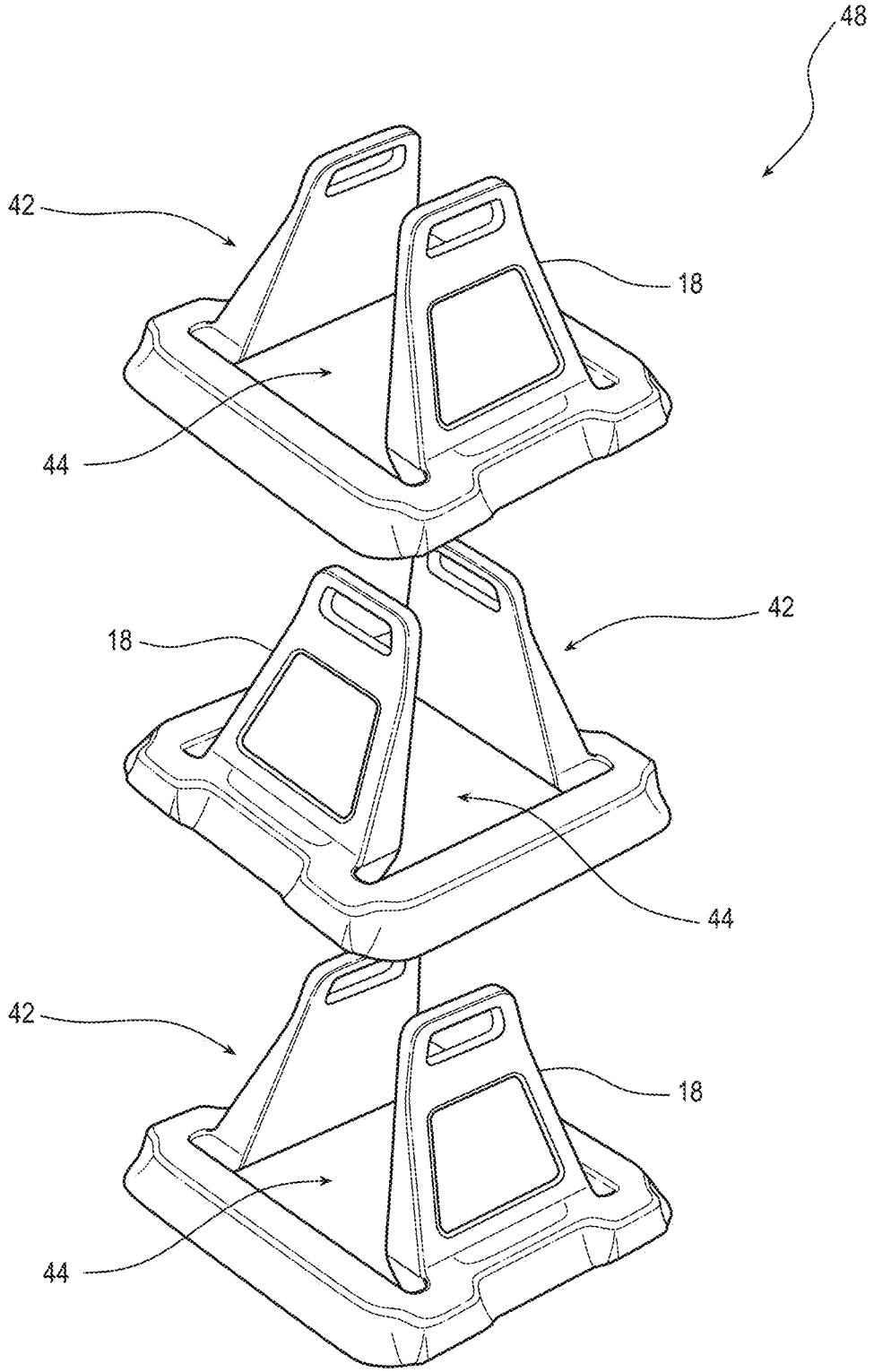
FIG. 21 illustrates an exploded perspective view thereof.
Figure 22:
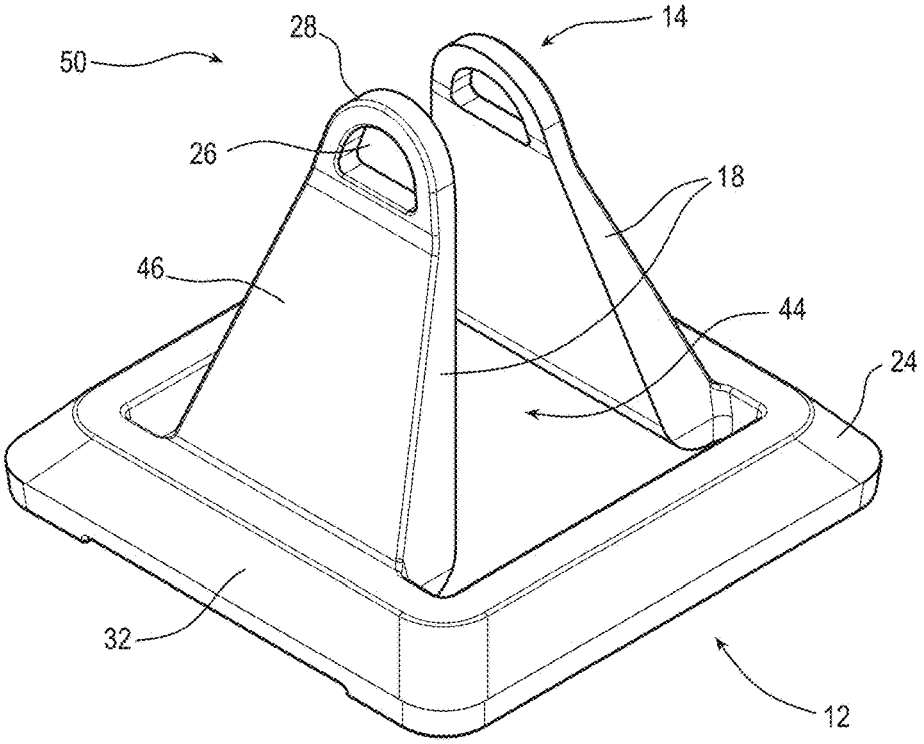
FIG. 22 illustrates a perspective view of another exemplary embodiment of a traffic director according to the present disclosure.
Figure 23:
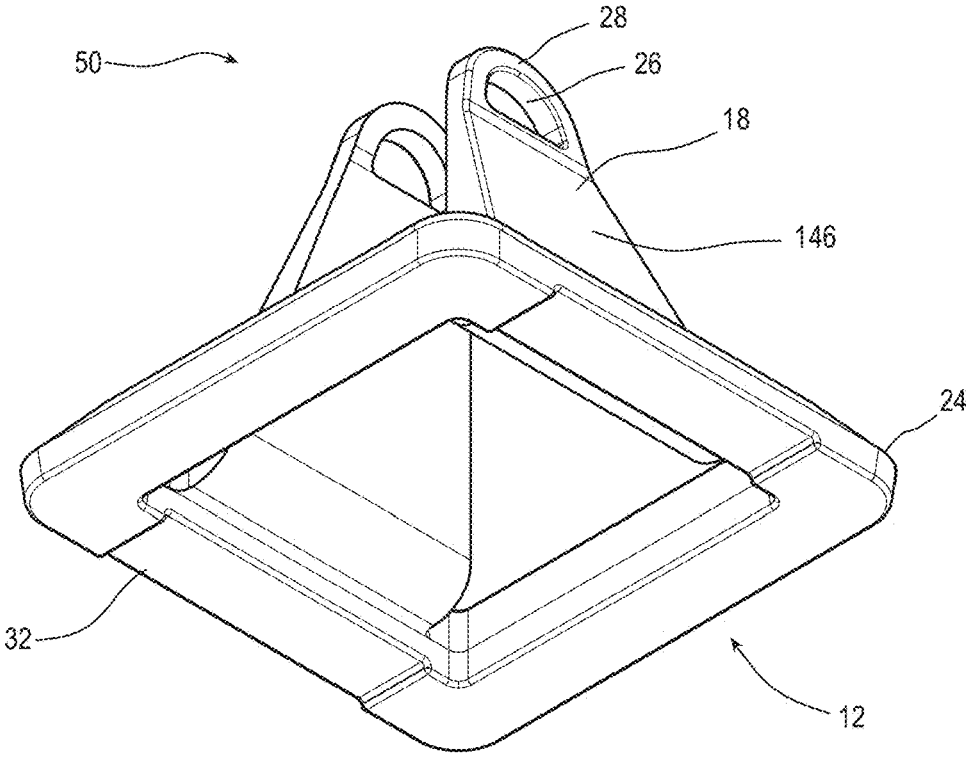
FIG. 23 illustrates an additional perspective view thereof.
Figure 24:
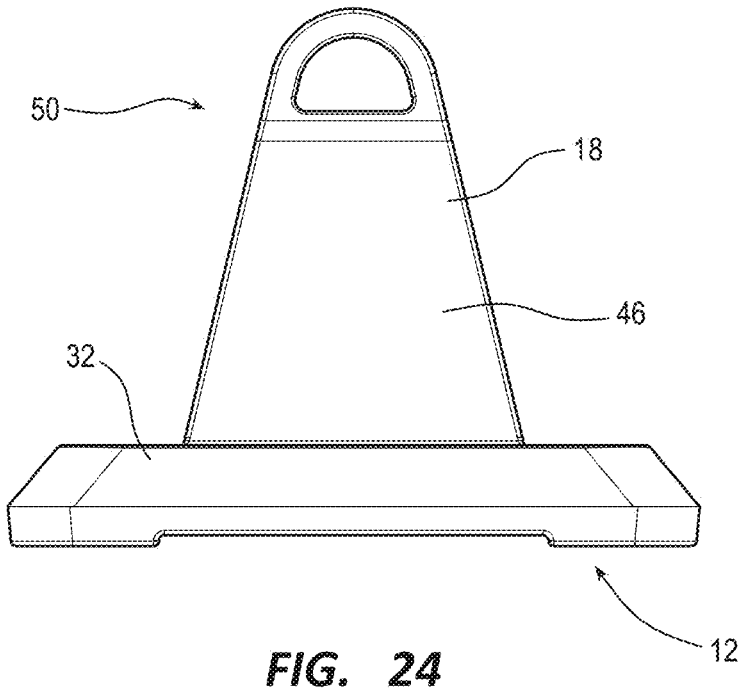
FIG. 24 illustrates a front view thereof.
Figure 25:
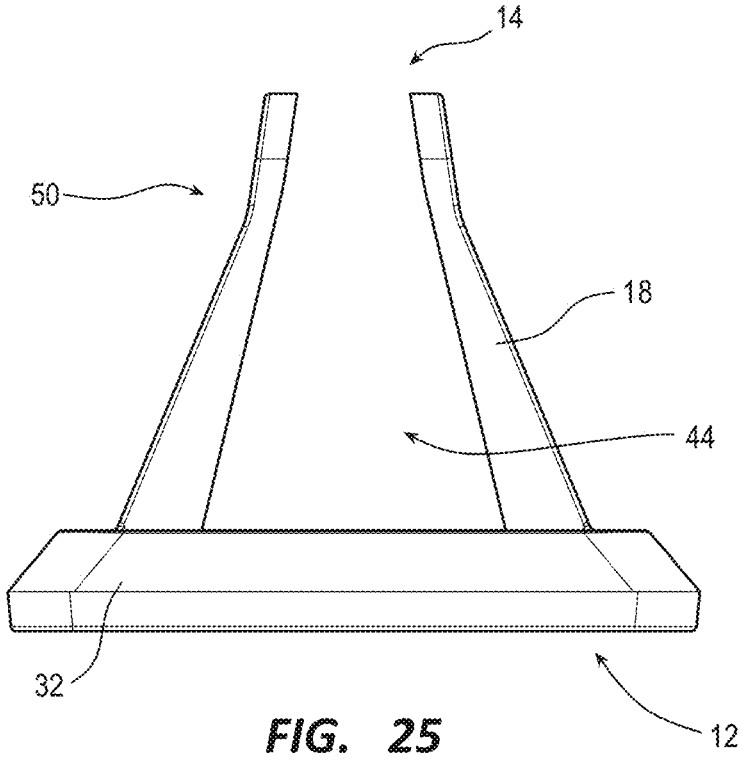
FIG. 25 illustrates a left side view thereof.
Figure 26:
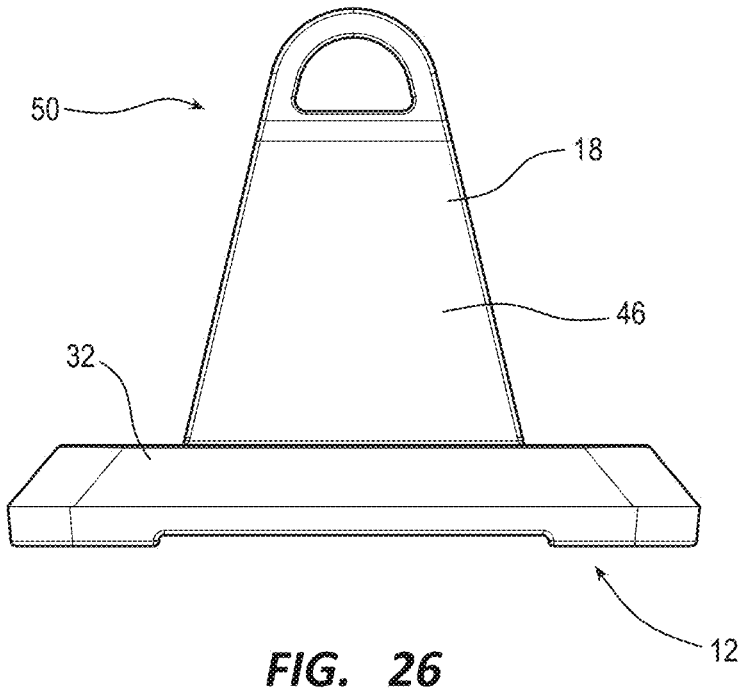
FIG. 26 illustrates a back view thereof.
Figure 27:
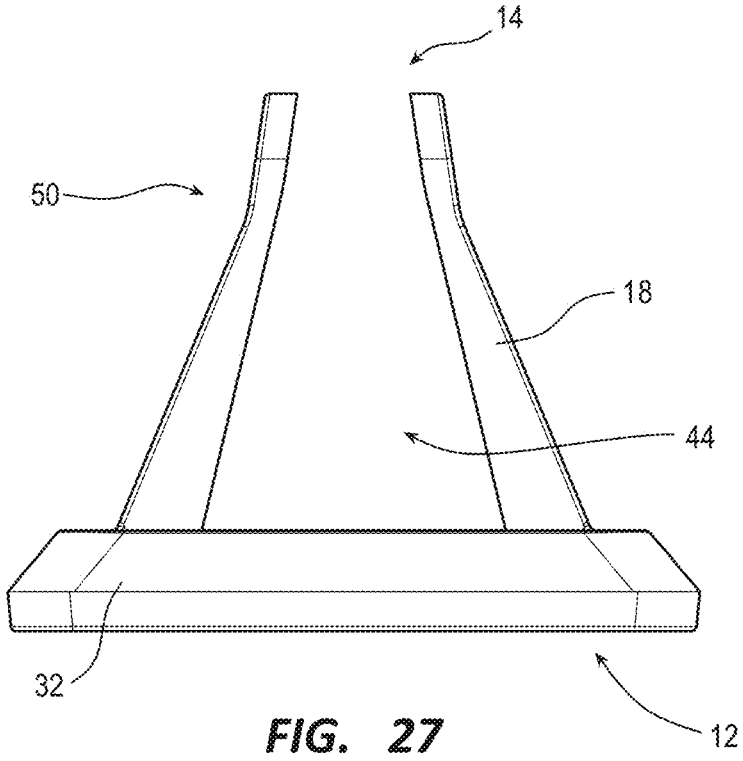
FIG. 27 illustrates a right side view thereof.
Figure 28:
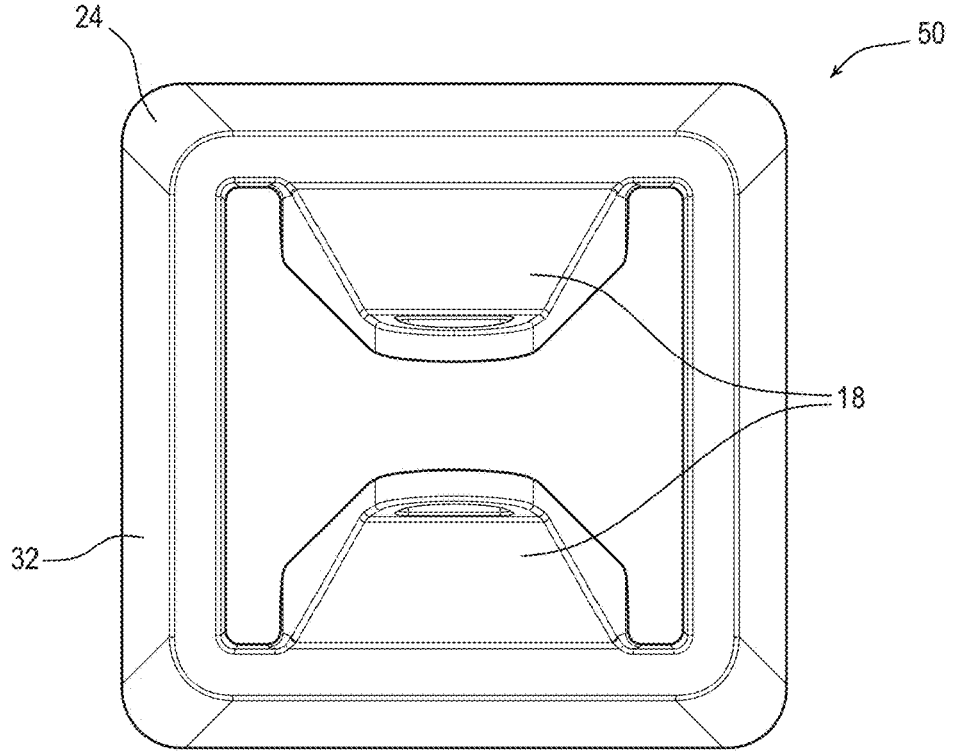
FIG. 28 illustrates a top view thereof.
Figure 29:
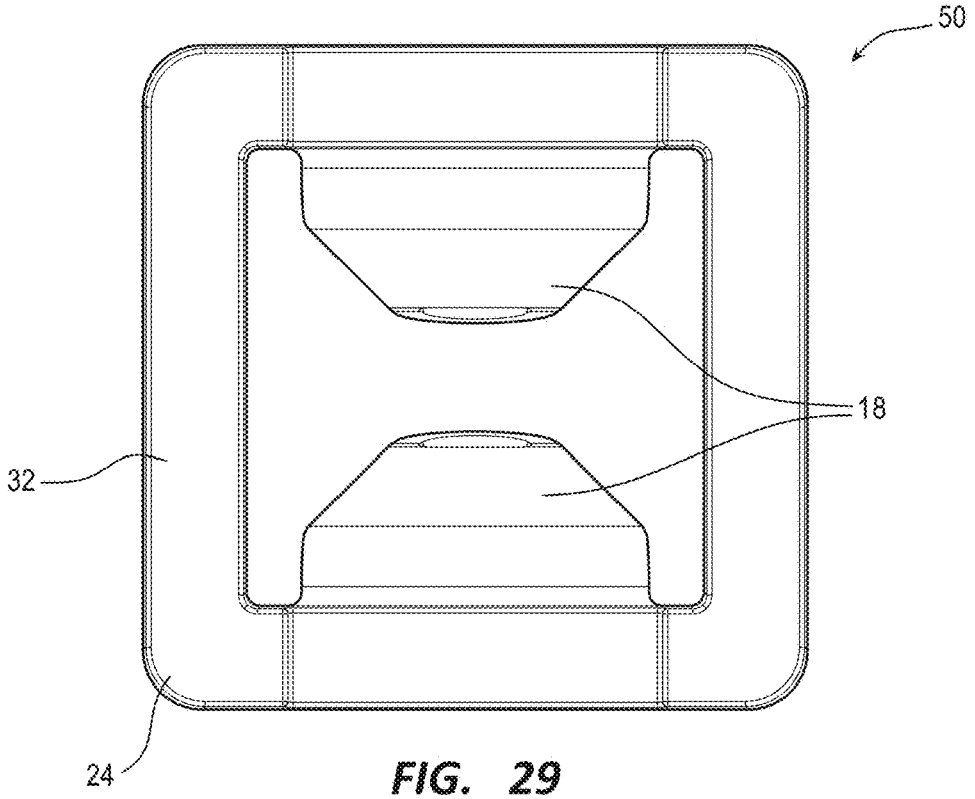
FIG. 29 illustrates a bottom view thereof.

In contrast to the embodiment illustrated in FIG. 1, major sides 16 (see FIG. 1) are not included in the embodiment illustrated in FIG. 13, resulting in an open space 44 between sides 18. As illustrated in FIG. 13, each open space 44 corresponds to a side 18 to allow for stacking of multiple traffic directors 42 as illustrated in FIG. 20 and described in the accompanying text. Also, the embodiment illustrated in FIG. 13 includes a directional indicator area 46 where any manner of directional indicator 30 (see FIG. 1) may be implemented. For example, directional indicators may be permanently or removably disposed on directional indicator area 46 in any manner disclosed herein.

In at least one embodiment, traffic director 42 includes one or more apertures 26 formed through one or more of sides 18, thus forming a handle 28 for grasping. Formation of handle 28 provides one or more grasping locations for a user to easily grab and lift traffic director 42. Aperture 26 not only forms handle 28, aperture 26 also reduces the weight of traffic director 42 and saves on material costs during manufacturing. In addition, aperture 26 can be strategically placed to increase the flexibility of various sides 18 and traffic director 42 overall to improve durability during use.

Figure 14:
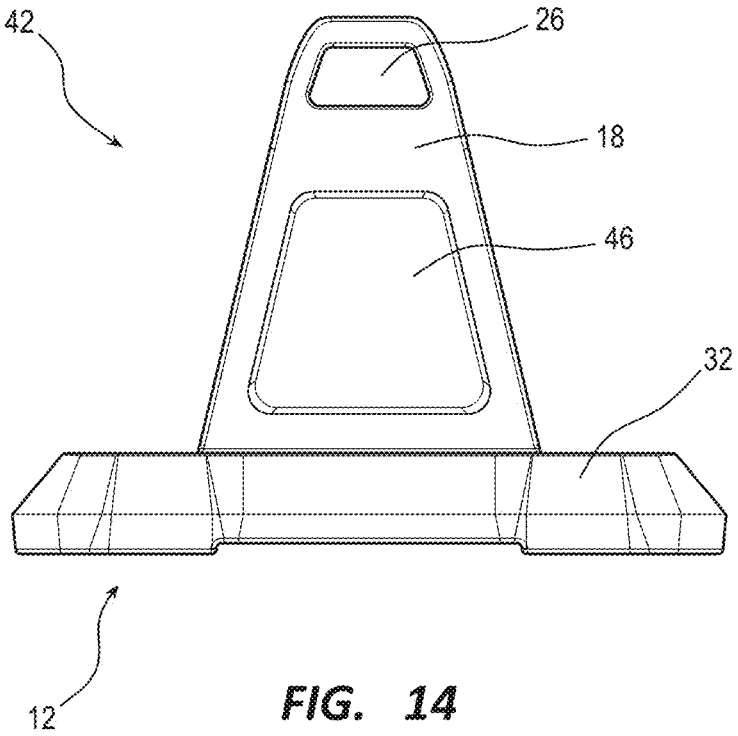
FIG. 14 illustrates a front view thereof.
Figure 15:
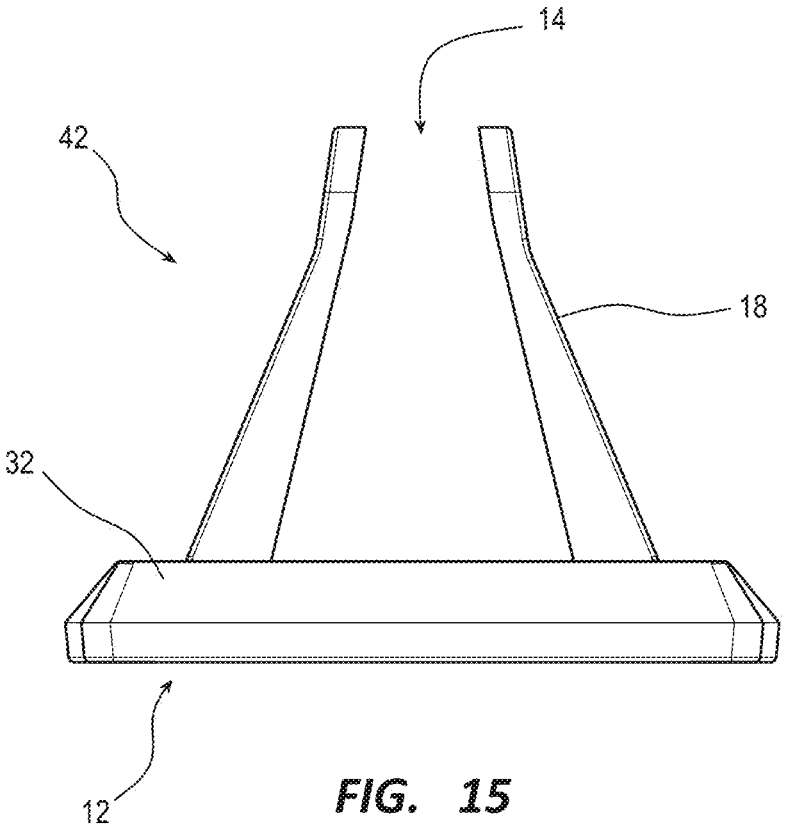
FIG. 15 illustrates a left side view thereof.
Figure 16:
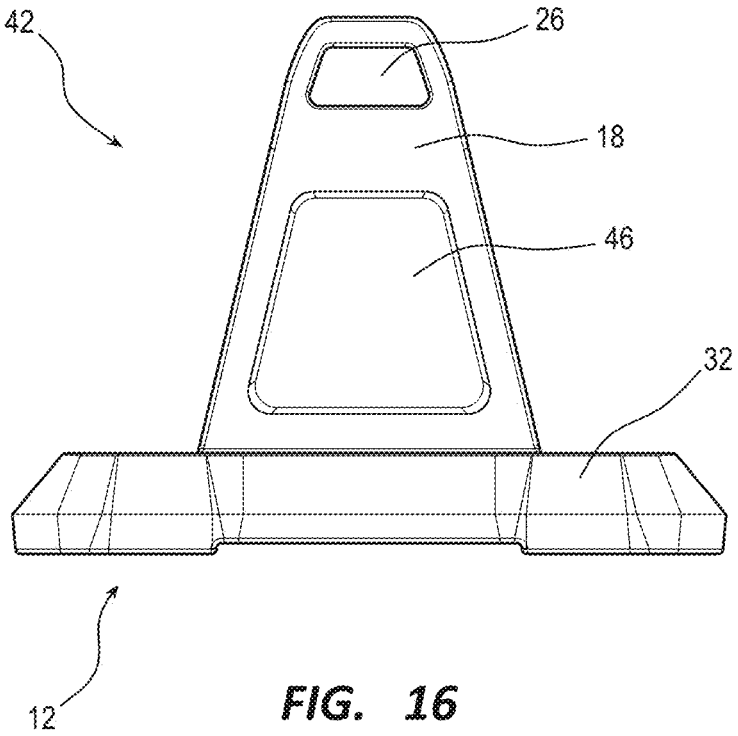
FIG. 16 illustrates a back view thereof.
Figure 17:
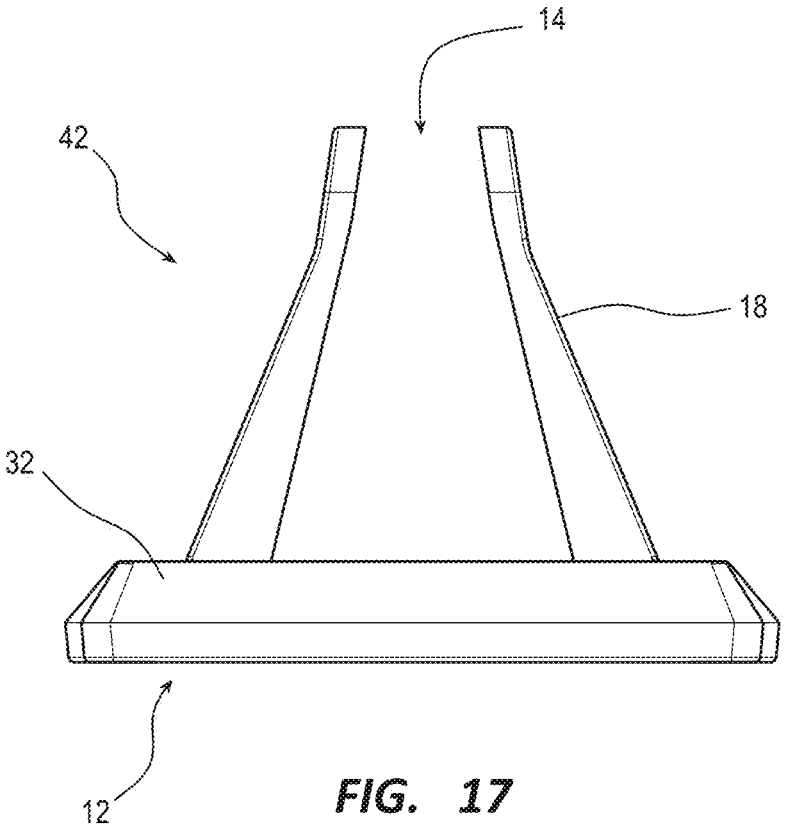
FIG. 17 illustrates a right side view thereof.
Figure 18:
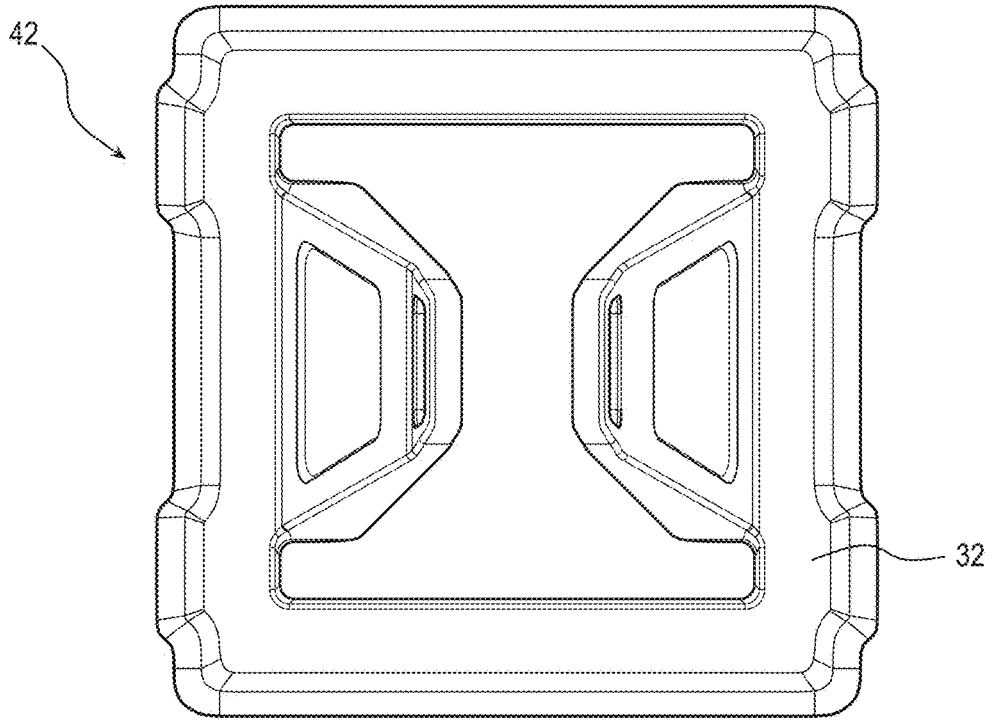
FIG. 18 illustrates a top view thereof.
Figure 19:
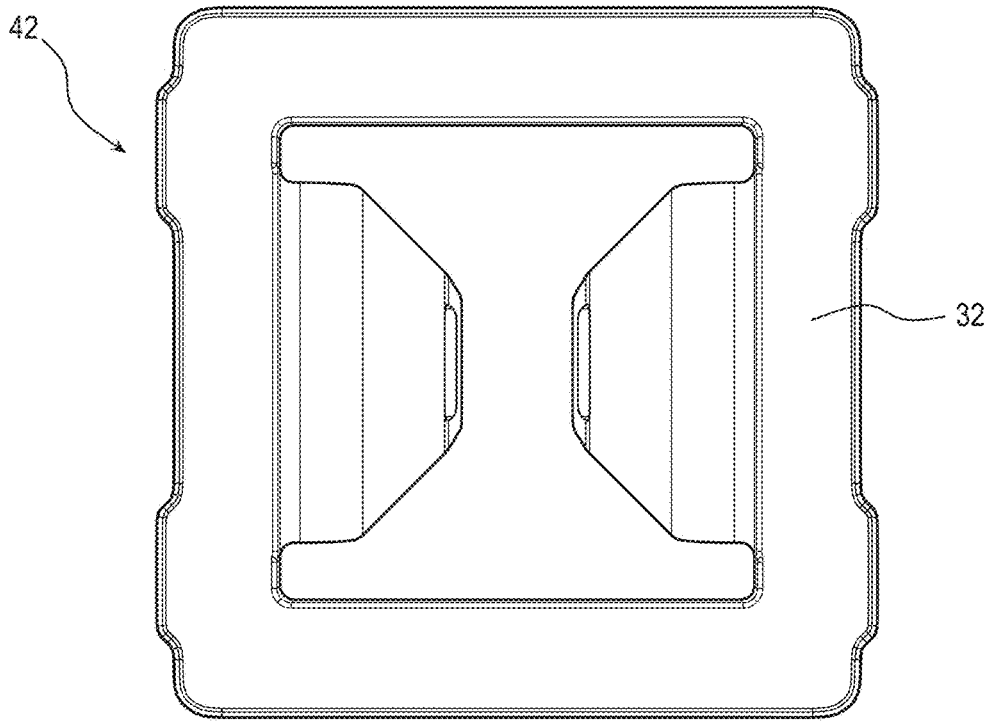
FIG. 19 illustrates a bottom view thereof.

FIGS. 14-19 illustrate various other views of traffic director 42, including a front view illustrated in FIG. 14, a left side view illustrated in FIG. 15, a back view illustrated in FIG. 16, a right side view illustrated in FIG. 17, a top view illustrated in FIG. 18, and a bottom view illustrated in FIG. 19. In each of FIGS. 14-19, the various features of traffic director 42 described herein are shown at various different angles to further clarify an embodiment of traffic director 42.

FIG. 20 illustrates a perspective view of an embodiment of a system 48 of traffic directors 42, wherein the traffic directors 42 are in a stacked configuration for transportation or storage. As illustrated, traffic directors 42 may be stacked in a spatially optimized configuration by arranging them such that sides 18 of one traffic director 42 occupy the open space 44 of another traffic director 42 by rotating each traffic director 42 by ninety degrees as they are being stacked. This process of stacking is further illustrated in FIG. 21, which illustrates an exploded perspective view of the system 48 of traffic directors 42. In at least one embodiment, several more traffic directors 42 than those illustrated may be stack, indeed up to one hundred or more traffic directors 42 may be stacked in the manner illustrated and disclosed herein.

FIGS. 22-29 illustrate an exemplary embodiment of a traffic director 50 configured for compact stacking similar to that of traffic director 42 (see FIGS. 13-21). In at least one embodiment, and as illustrated in FIGS. 22-29, the handle 28 of traffic director 50 may comprise a substantially rounded shape, thus providing for an aperture 26 of increased size. One should appreciate that embodiments of the present disclosure may include a variety of shapes and sizes of traffic directors, as well as corresponding handles 28 and apertures 26. For example, while embodiments illustrated herein generally show traffic directors having sides extending upward at an angle, alternative embodiments include sides of various shapes, sizes, and angles (or lack thereof), as well as components and features that are integral or separable, as well as interchangeable or permanent.

Figure 30:
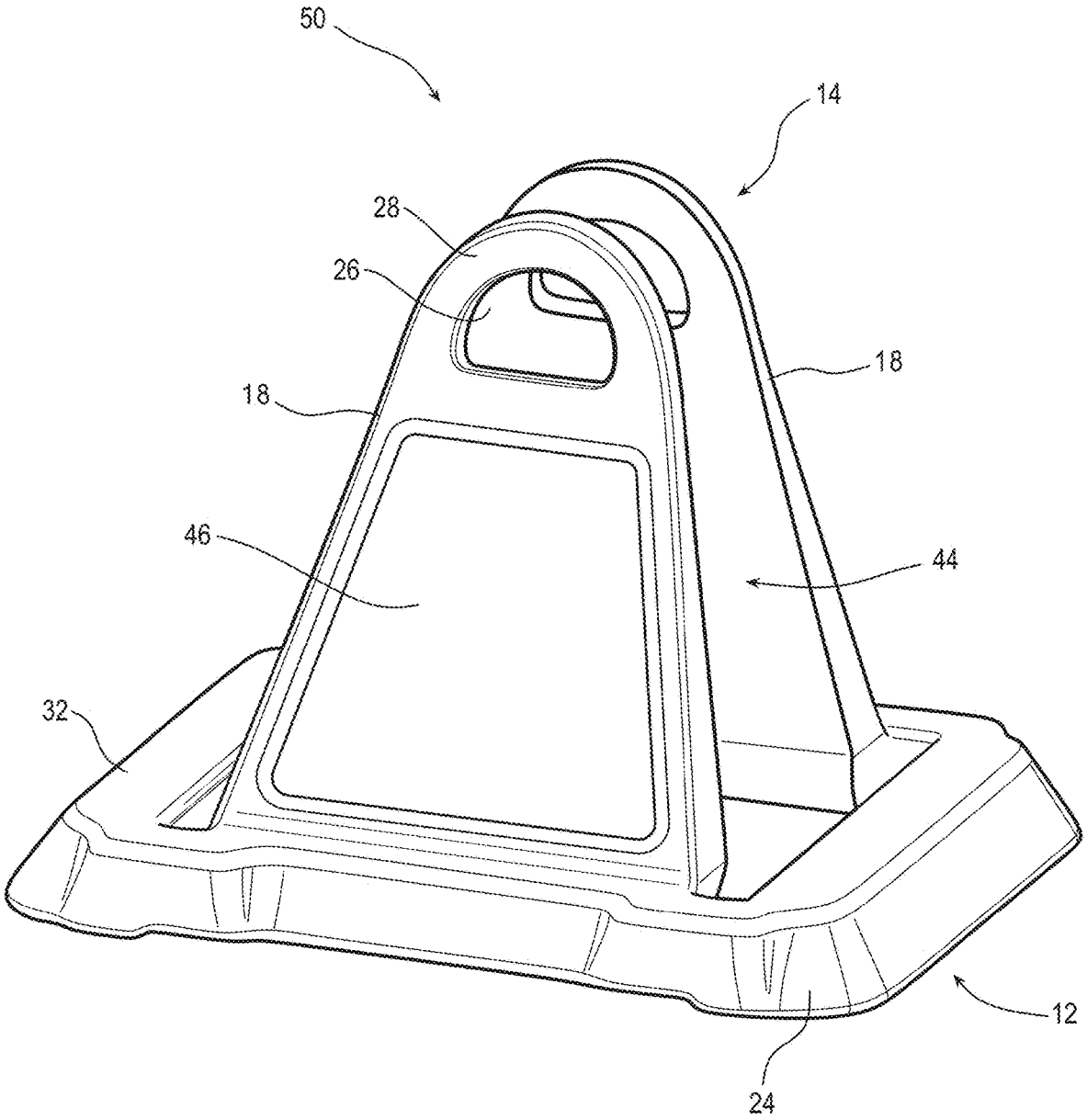
FIG. 30 illustrates a perspective view of another exemplary embodiment of a traffic director according to the present disclosure.

FIG. 30 illustrates a perspective view of an embodiment of traffic director 50 similar to the embodiments illustrated in FIGS. 22-29, the principal difference being that directional indicator area 46 comprises an inlaid surface on side 18.

Figure 31:
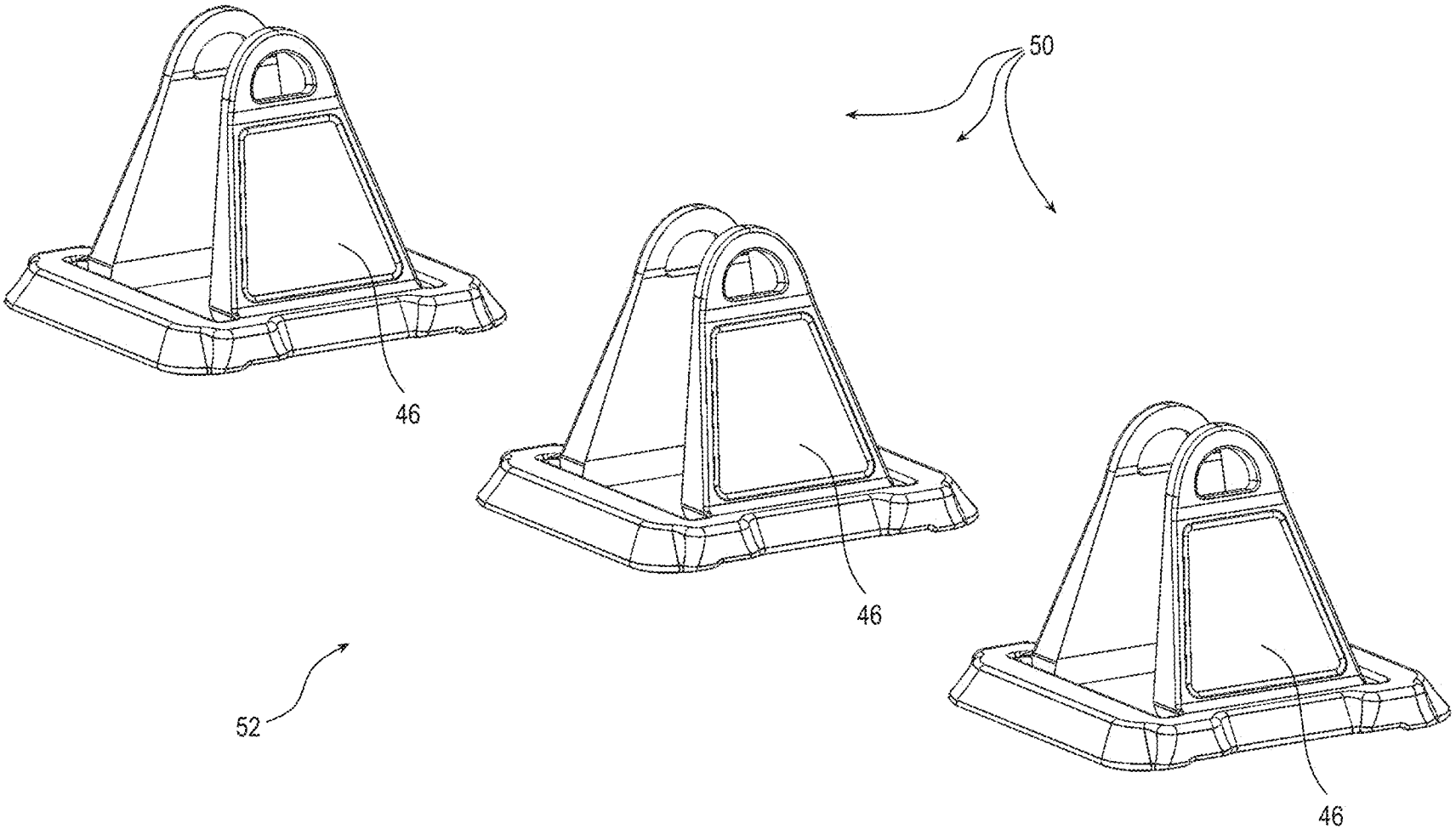
FIG. 31 illustrates a perspective view of an embodiment of a system of traffic directors, arranged together for directing traffic, according to the present disclosure.

FIG. 31 illustrates a perspective view of an embodiment of a system 52 of traffic directors 50, wherein the traffic directors 50 are arranged in a pattern for directing traffic. As illustrated, each traffic director 50 may include a directional indicator area 46 upon which a desired directional indicator may be implemented. For example, at least one embodiment includes a directional indicator area 46 with a surface configured for nonpermanent markings. Alternatively, some embodiments include interchangeable directional indicators that may be selectively secured to the directional indicator area 46.

Figure 32A:
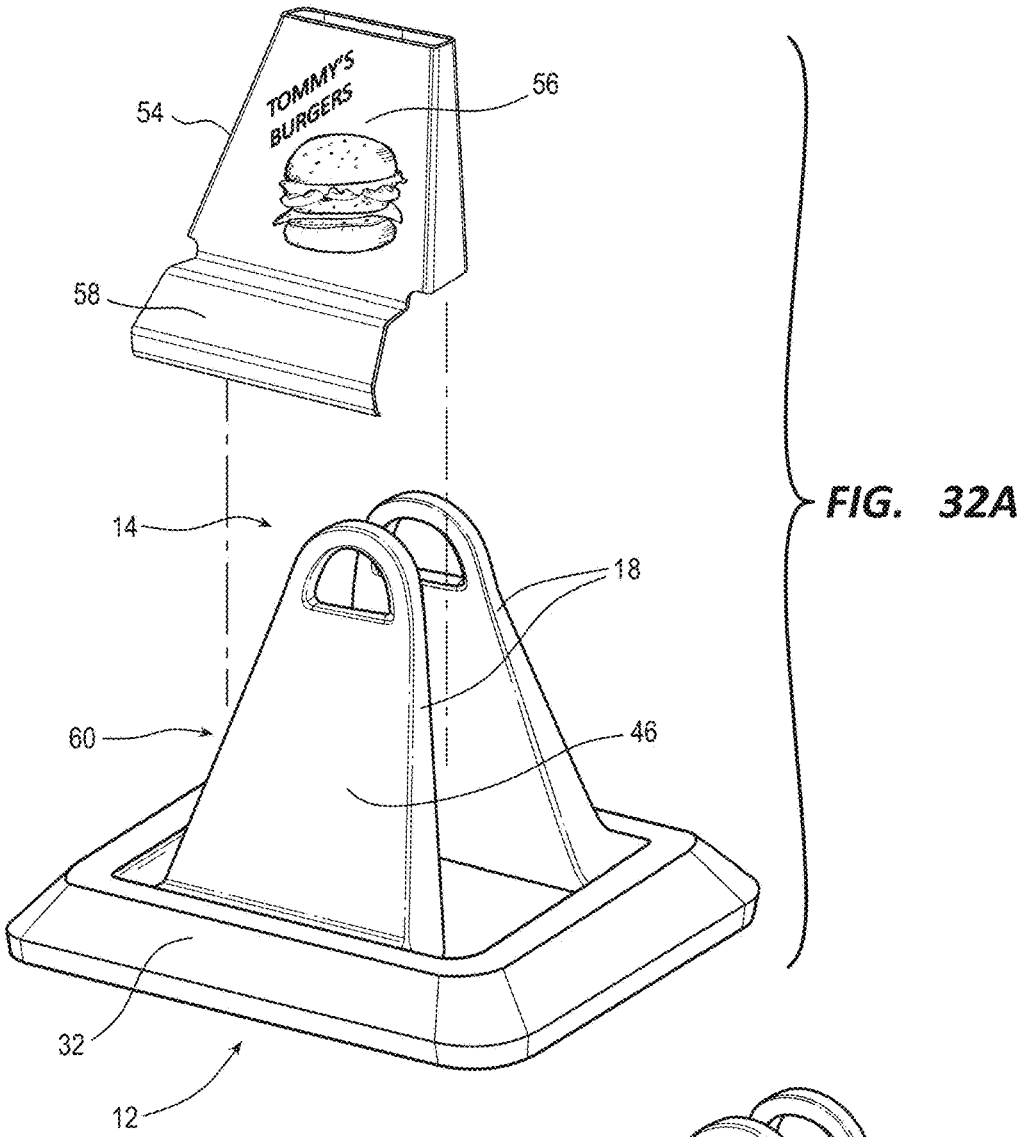
FIG. 32A illustrates an exploded perspective view of an exemplary embodiment of a traffic director and a removable indicator sleeve according to the present disclosure.
Figure 32B:
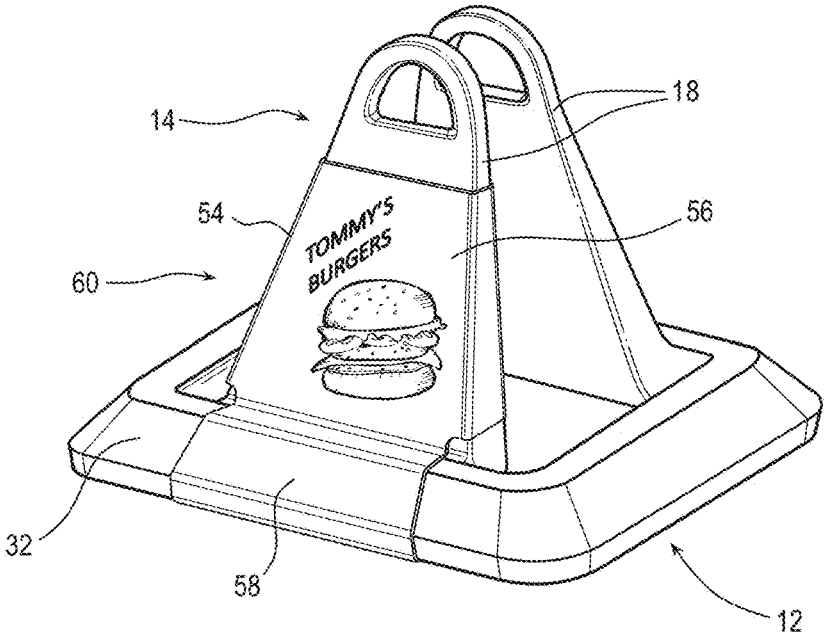
FIG. 32B illustrates an assembled perspective view thereof.
Figure 32C:
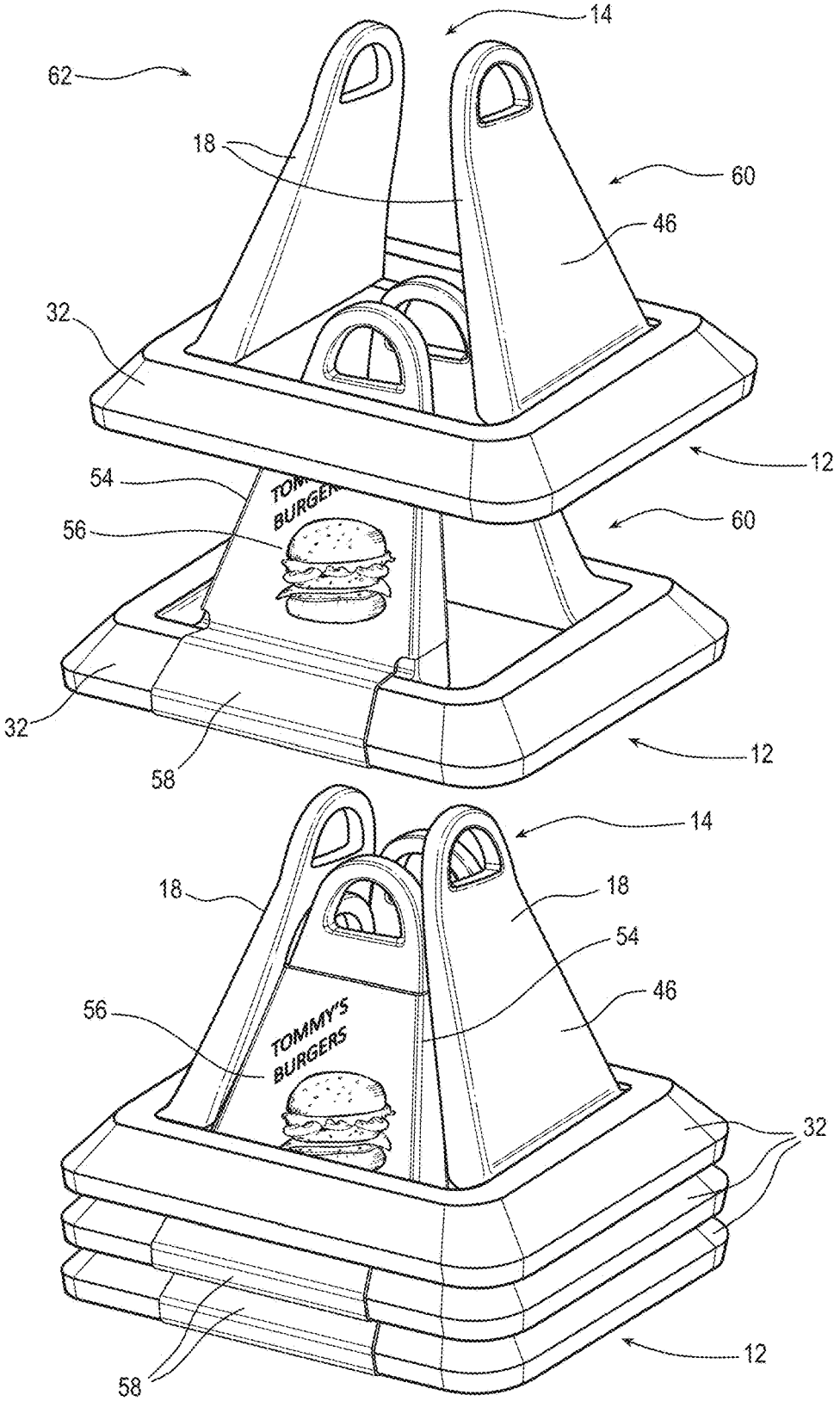
FIG. 32C illustrates an exploded perspective view of an embodiment of a system of traffic directors with removable indicator sleeves in a stacked configuration, according to the present disclosure.

FIGS. 32A-32C illustrate a removable indicator sleeve 54 that can be included with various embodiments to provide additional options and customization of traffic directors according to the present disclosure. As illustrated, some embodiments of removable indicator sleeve 54 comprise an advertisement graphic 56. In some embodiments, advertisement graphic 56 can also serve as a directional indicator or any other information that a user desires to display. The embodiment shown also includes a tab 58 configured to removably secure removable indicator sleeve 54 to a traffic director. With removable indicator sleeve 54, a user can purchase any number of advertisements, indicators, or the like without the need for additional traffic directors. For example, in scenarios where traffic is being directed in proximity to a business entrance, one or more removable indicator sleeves 54 can be implemented to notify drivers of or direct drivers to the business entrance, thus avoiding potential confusion or loss of business due to the surrounding construction.

As shown in FIG. 32A, for example, removable indicator sleeve 54 is positioned to slide over side 18 of a traffic director 60 at a distal end 14 towards a proximal end 12. Removable indicator sleeve 54 can then be removably secured to base 32 of traffic director 60, as shown in FIG. 32B. In some embodiments, tab 58 removably secures to traffic director 60 by hook and loop fastener, button snaps, magnets, or any similar attachment means. Some embodiments may not include tab 58 and thus are removably secured to traffic director 60 by alternative means, such as hook and loop fastener or magnets corresponding to side 18 of traffic director 60, a frictional fit, or the like. In some embodiments, removable indicator sleeve 54 is constructed of a rigid material, such as plastic, while in further embodiments removable indicator sleeve 54 may be constructed of a flexible material, such as nylon, cloth, or the like. While FIGS. 32A-32C illustrate removable indicator sleeve 54 in coordination with one embodiment of traffic director 60, embodiments of removable indicator sleeves may be configured for installation on various embodiments of traffic indicators according to the present disclosure.

FIG. 32C illustrates an embodiment of a system 62 of traffic directors 60, wherein a plurality of traffic directors 60 are stacked upon one another whilst having removable indicator sleeves 54 are installed on one or more traffic directors 60. As illustrated, removable indicator sleeves 54 are configured to integrate with traffic directors 60 without substantially altering the shape or size of the traffic director 60 when installed. Additionally, some embodiments comprise traffic directors 60 having directional indicators 30 permanently associated with sides 16 or 18 (see FIGS. 1-12) or directional indicator areas 46 (see FIGS. 13-31), whilst allowing for the installation of removable indicator sleeves 54 when additional indicators or advertisement graphics 56 are needed.

Following are some further example embodiments of the invention. These are presented only by way of example and are not intended to limit the scope of the invention in any way.

Embodiment 1. A traffic director, comprising a distal end, a proximal end, two or more sides extending upward from the proximal end to the distal end, one or more flexion points, and a directional indicator disposed on at least one of the two or more sides.

Embodiment 2. The traffic director as recited in embodiment 1, wherein at least one of the one or more flexion points comprises a notch disposed at or near the proximal end of the traffic director, the notch comprising a portion of removed material between two adjacent sides of the two or more sides.

Embodiment 3. The traffic director as recited in any of embodiments 1-2, wherein at least one of the one or more flexion points comprises a recessed channel extending across at least one of the two or more sides.

Embodiment 4. The traffic director as recited in any of embodiments 1-3, wherein the proximal end comprises a base and the two or more sides extend upward from the base at an angle toward a central axis of the traffic director.

Embodiment 5. The traffic director as recited in any of embodiments 1-4, wherein at least one of the two or more sides comprises a major side and at least one other of the two or more sides comprises a minor side, wherein the major side extends further upward from the proximal end than the minor side.

Embodiment 6. The traffic director as recited in any of embodiments 1-5, wherein the two or more sides comprise four sides, the traffic director forming a square pyramid.

Embodiment 7. The traffic director as recited in any of embodiments 1-6, wherein an aperture extends through at least one of the two or more sides, the aperture forming a handle.

Embodiment 8. The traffic director as recited in any of embodiments 1-7, wherein the directional indicator includes an arrow.

Embodiment 9. The traffic director as recited in any of embodiments 1-8, the directional indicator includes a stop sign.

Embodiment 10. A traffic director, comprising a distal end and a proximal end; two or more sides extending upward from the proximal end at an angle toward the distal end and having a substantially equal width, each of the two or more sides being separated from one another by a distance equal to the substantially equal width; and two or more openings defined by the distance between the two or more sides, wherein there are an equal number of sides and openings.

Embodiment 11. The traffic director as recited in embodiment 10, further comprising a base having four edges, each of the four edges extending outward from the two or more sides at the proximal end.

Embodiment 12. The traffic director as recited in any of embodiments 10-11, wherein the two or more sides comprises two sides extending upward from two opposing edges of the square base, and the two or more openings comprise two openings further defined by the remaining two edges of the square base.

Embodiment 13. The traffic director as recited in any of embodiments 11-12, further comprising an aperture extending through at least one of the two or more sides, the aperture forming a handle.

Embodiment 14. The traffic director as recited in any of embodiments 10-13, further comprising a directional indicator disposed on at least one of the two or more sides.

Embodiment 15. The traffic director as recited in any of embodiments 10-14, further comprising a removable indicator sleeve configured to removably secure to one of the two or more sides of the traffic director.

Embodiment 16. The traffic director as recited in any of embodiments 10-15, wherein the removable indicator sleeve has an advertisement printed on an outside surface thereof.

Embodiment 17. A system of traffic directors, comprising a plurality of traffic directors, each traffic director of the plurality of traffic directors comprising: a distal end and a proximal end; two or more sides extending upward from the proximal end at an angle toward the distal end, each of the two or more sides being at least partially separated from one another; an opening proximate the distal end, the opening defined by a distance between each of the two or more sides proximate the distal end; and a first directional indicator disposed on at least one of the two or more sides, wherein each of the plurality of traffic directors is arranged in position relative to one or more other traffic directors of the plurality of traffic directors such that the directional indicator conveys instructions to a driver of a vehicle approaching the system of traffic directors during use.

Embodiment 18. The system of traffic directors as recited in embodiment 17, wherein each traffic director of the plurality of traffic directors further comprises a second directional indicator disposed on at least one of the two or more sides, the second directional indicator being disposed on a different side than the first directional indicator.

Embodiment 19. The system of traffic directors as recited in any of embodiments 17-18, wherein the first directional indicator is different than the second directional indicator.

Embodiment 20. The system of traffic directors as recited in any of embodiments 17-19, wherein the first directional indicator is an arrow and the second directional indicator is a stop sign.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An indicator sleeve configured for use with a traffic director, the indicator sleeve comprising:

a receptacle configured to removably receive therein a side panel of the traffic director, the receptacle having four generally trapezoidal shaped side panels, the four generally trapezoidal shaped side panels cooperating to give the receptacle a generally frustum shape, the four generally trapezoidal shaped side panels having interiors surfaces that cooperate to form an interior shape of the receptacle that generally corresponds to a shape of the side panel of the traffic director, the four generally trapezoidal shaped side panels having lower ends that cooperate to define an opening in a lower end of the receptacle through which the side panel of the traffic director may be received, at least one of the four generally trapezoidal shaped side panels has an outwardly facing surface having or being configured to have an advertisement or directional indicator printed or otherwise disposed thereon; and an attachment mechanism configured to selectively secure the indicator sleeve to the traffic director, the attachment mechanism being integrally formed with or extending from only one of the four trapezoidal shaped side panels, the attachment mechanism being configured to extends outwardly and downwardly from the only one of the four trapezoidal shaped side panels such that the attachment mechanism extends outwardly and below a lower end of the receptable, the attachment mechanism being configured to extend over and attach to an outwardly facing surface of a base of the traffic director, wherein the attachment mechanism comprises a hook and loop fastener, one or more button snaps, or one or more magnets.

2. The indicator sleeve of claim 1, wherein the attachment mechanism comprises a tab configured to selectively secure the removable indicator sleeve to the traffic director.

3. The indicator sleeve of claim 2, wherein the tab comprises the hook and loop fastener, one or more button snaps, or one or more magnets.

4. The indicator sleeve of claim 2, wherein the tab is configured to be selectively secured to the base of the traffic director.

5. The indicator sleeve of claim 1, wherein the attachment mechanism extends along an entire width of the only one of the four trapezoidal shaped side panels.

6. The indicator sleeve of claim 1, wherein the receptacle comprises an opening in an upper end thereof through which a portion of the traffic indicator is configured to extend out of.

7. The indicator sleeve of claim 1, wherein the receptacle tapers in two directions between the lower end and an upper end.

8. The indicator sleeve of claim 1, wherein the indicator sleeve is formed of a flexible material.

9. A traffic director system, comprising:

a traffic director, comprising:

a base having a plurality of sides; and a side panel extending upwardly from a first side of the plurality of sides of the base, the side panel having a proximal end attached or attachable to the base and a distal end opposite to the proximal end, the side panel being offset from the first side such that the first side extends outwardly relative to the side panel; and a removable indicator sleeve configured to be selectively positioned over the side panel, the removable indicator sleeve comprising:

a receptacle configured to removably receive therein the side panel of the traffic director, the receptacle having four generally trapezoidal shaped side panels, the four generally trapezoidal shaped side panels cooperating to give the receptacle a generally frustum shape, the four generally trapezoidal shaped side panels having interiors surfaces that cooperate to form an interior shape of the receptacle that generally corresponds to a shape of the side panel of the traffic director, the four generally trapezoidal shaped side panels having lower ends that cooperate to define an opening in a lower end of the receptacle through which the side panel of the traffic director may be received, at least one of the four generally trapezoidal shaped side panels has an outwardly facing surface having or being configured to have an advertisement or directional indicator printed or otherwise disposed thereon; and a tab that is configured to be selectively secured to the first side of the base of the traffic director, the tab extending or being configured to extend outwardly from the at least one of the four generally trapezoidal shaped side panels so as to extend over an outer surface of the first side of the base, the tab extending or being configured to extend downwardly from the at least one of the four generally trapezoidal shaped side panels such that the tab extends below the lower end of the receptable, the tab comprises a hook and loop fastener, one or more button snaps, or one or more magnets.

10. The traffic director system of claim 9, wherein the receptacle tapers from a first dimension at the lower end to a second, smaller dimension at the upper end.

11. An indicator sleeve configured for use with a traffic director, the indicator sleeve comprising:

a sleeve portion formed of a plurality of walls that form a generally frustum shaped tubular structure configured to be slid over or otherwise disposed around a side panel of a traffic indicator, at least two of the plurality of walls having generally trapezoidal shapes, the plurality of walls having interiors surfaces that cooperate to form an interior shape of the sleeve portion that generally corresponds to a shape of the side panel of the traffic director, the plurality of walls having lower ends that cooperate to define an opening in a lower end of the sleeve portion through which the side panel of the traffic director may be received, the plurality of walls having upper ends that cooperate to define an opening in an upper end of the sleeve portion through which a portion of the side panel of the traffic director may extend out of the sleeve, at least one wall of the plurality of walls having an outwardly facing generally planar face having or being configured to have an advertisement or directional indicator printed or otherwise disposed on an outside surface thereof; and a tab being integrally formed with and extending from only one wall of the plurality of walls, the tab extending or being configured to extend from a lower end of the only one wall of the plurality of walls, the tab extending in a downward and outward direction away from an interior and the lower end of the sleeve portion, the tab being configured to extend over and be selectively connected to an outwardly facing surface of a base of the traffic indicator to selectively hold the indicator sleeve on the traffic indicator, the tab comprising a hook and loop fastener, one or more button snaps, or one or more magnets.

12. The indicator sleeve of claim 11, wherein the sleeve portion tapers in at least two directions between the lower end and the upper end thereof.

* * * * *